US007138975B2

(12) United States Patent
Koyama

(10) Patent No.: US 7,138,975 B2
(45) Date of Patent: Nov. 21, 2006

(54) DISPLAY DEVICE AND ELECTRIC EQUIPMENT USING THE SAME

(75) Inventor: Jun Koyama, Kanagawa (JP)

(73) Assignee: Semiconductor Energy Laboratory Co., Ltd., Atsugi (JP)

( * ) Notice: Subject to any disclaimer, the term of this patent is extended or adjusted under 35 U.S.C. 154(b) by 422 days.

(21) Appl. No.: 10/251,790

(22) Filed: Sep. 23, 2002

(65) Prior Publication Data

US 2003/0063077 A1 Apr. 3, 2003

(30) Foreign Application Priority Data

Oct. 1, 2001 (JP) ..... 2001-305778

(51) Int. Cl.
*G09G 3/36* (2006.01)

(52) U.S. Cl. ..... 345/100; 345/89

(58) Field of Classification Search ..... 345/76, 345/82, 100, 204
See application file for complete search history.

(56) References Cited

U.S. PATENT DOCUMENTS

| | | | | |
|---|---|---|---|---|
| 5,412,397 | A | 5/1995 | Kanatani et al. | |
| 5,600,344 | A | 2/1997 | Sono et al. | |
| 5,712,653 | A | 1/1998 | Katoh et al. | |
| 5,818,419 | A | 10/1998 | Tajima et al. | |
| 6,023,260 | A | 2/2000 | Higashi | |
| 6,025,835 | A | 2/2000 | Aoki et al. | |
| 6,037,917 | A | 3/2000 | Kawakami | |
| 6,040,812 | A | 3/2000 | Lewis | |
| 6,064,364 | A | 5/2000 | Katoh et al. | |
| 6,088,012 | A | 7/2000 | Shigeta et al. | |
| 6,115,017 | A | 9/2000 | Mikami et al. | |
| 6,229,505 | B1 * | 5/2001 | Fujii | 345/76 |
| 6,329,973 | B1 | 12/2001 | Akimoto et al. | |
| 6,337,677 | B1 | 1/2002 | Higashi | |
| 6,339,422 | B1 * | 1/2002 | Kuwajima et al. | 345/204 |
| 6,356,028 | B1 | 3/2002 | Legagneux et al. | |

(Continued)

FOREIGN PATENT DOCUMENTS

EP 0 362 974 4/1990

(Continued)

OTHER PUBLICATIONS

U.S. Appl. No. 10/118,917, filed Apr. 10, 2002, Koyama.

(Continued)

*Primary Examiner*—Richard Hjerpe
*Assistant Examiner*—M. Fatahi-Yar
(74) *Attorney, Agent, or Firm*—Fish & Richardson P.C.

(57) ABSTRACT

A display device which can operate at low power consumption is provided. When multi gray scale display is conducted and when display in which the number of gray scales is reduced is conducted, signal line driver circuits having different structures (first signal line driver circuit and second signal line driver circuit) are provided according to the respective cases. Those signal line driver circuits are separately used to conduct the display. The signal line driver circuit having the structure according to the number of gray scales to be represented is used to conduct the display. Thus, redundant power consumption can be prevented in the display device. Further, a decoder is used as a scanning line driver circuit and pixel rows are selected in an arbitrary order. Therefore, a region displayed by the first signal line driver circuit or a region displayed by the second signal line driver circuit can be set in a frame. Accordingly, a region for which the multi gray scale display is required and a region for which the display in which the number of gray scales is reduced is sufficient are selected in one frame so that power consumption can be effectively reduced.

80 Claims, 21 Drawing Sheets

U.S. PATENT DOCUMENTS

| | | | | |
|---|---|---|---|---|
| 6,396,508 | B1 | 5/2002 | Noecker | |
| 6,417,824 | B1 | 7/2002 | Tokunaga et al. | |
| 6,552,736 | B1 | 4/2003 | Honda et al. | |
| 6,617,785 | B1 | 9/2003 | Shibata et al. | |
| 6,646,625 | B1 | 11/2003 | Shigeta et al. | |
| 6,678,834 | B1 | 1/2004 | Aihara et al. | |
| 6,693,614 | B1 | 2/2004 | Kamiya et al. | |
| 6,738,036 | B1 * | 5/2004 | Janssen et al. | 345/87 |
| 6,806,859 | B1 * | 10/2004 | Kanoh et al. | 345/98 |
| 6,867,761 | B1 | 3/2005 | Matsueda | |
| 6,894,674 | B1 | 5/2005 | Nakajima et al. | |
| 2001/0005196 | A1 * | 6/2001 | Ishii | 345/100 |
| 2001/0011989 | A1 * | 8/2001 | Hayashi | 345/100 |
| 2001/0013848 | A1 | 8/2001 | Shibata et al. | |
| 2002/0000969 | A1 * | 1/2002 | Ozawa | 345/100 |
| 2002/0024496 | A1 | 2/2002 | Akimoto et al. | |
| 2002/0041278 | A1 | 4/2002 | Matsueda | |
| 2002/0047568 | A1 | 4/2002 | Koyama | |
| 2002/0047852 | A1 * | 4/2002 | Inukai et al. | 345/629 |
| 2002/0057251 | A1 | 5/2002 | Higashi | |
| 2002/0075249 | A1 | 6/2002 | Kubota et al. | |
| 2002/0154151 | A1 * | 10/2002 | Koyama | 345/690 |
| 2003/0001800 | A1 | 1/2003 | Nakajima et al. | |
| 2003/0174153 | A1 | 9/2003 | Koyama | |
| 2004/0095364 | A1 | 5/2004 | Koyama et al. | |
| 2005/0078073 | A1 | 4/2005 | Mikami et al. | |
| 2005/0151729 | A1 | 7/2005 | Akimoto et al. | |
| 2005/0168428 | A1 | 8/2005 | Nakajima et al. | |
| 2005/0243588 | A1 | 11/2005 | Kabota et el. | |

FOREIGN PATENT DOCUMENTS

| | | | |
|---|---|---|---|
| EP | 0 558 056 | | 9/1993 |
| EP | 0 760 508 | | 3/1997 |
| EP | 0 797 182 | | 9/1997 |
| EP | 0 852 371 | | 8/1998 |
| EP | 1 103 946 | | 5/2001 |
| EP | 1 184 833 | | 3/2002 |
| EP | 193 675 | | 4/2002 |
| EP | 1 343 134 | | 10/2003 |
| EP | 1 603 109 | | 12/2005 |
| EP | 1 603 110 | | 12/2005 |
| GB | 2177829 | A * | 1/1987 |
| JP | 02-210985 | | 8/1990 |
| JP | 03-051887 | | 3/1991 |
| JP | 05-241127 | | 9/1993 |
| JP | 07-253566 | | 10/1995 |
| JP | 08-069690 | | 3/1996 |
| JP | 08-171080 | | 7/1996 |
| JP | 08-314409 | | 11/1996 |
| JP | 09-281933 | | 10/1997 |
| JP | 09-331490 | | 12/1997 |
| JP | 11-133921 | | 5/1999 |
| JP | 2000-187470 | | 7/2000 |
| JP | 2001-176668 | | 6/2001 |
| JP | 2001-343933 | | 12/2001 |
| JP | 2002-032048 | | 1/2002 |
| JP | 2002-108285 | | 4/2002 |
| JP | 2002-149113 | | 5/2002 |
| JP | 2002-175045 | | 6/2002 |
| JP | 2002-202747 | | 7/2002 |
| JP | 2003-015609 | | 1/2003 |
| TW | 7817405 | | 9/1989 |
| WO | WO96-024123 | | 8/1996 |
| WO | WO97-011447 | | 3/1997 |
| WO | WO98-002773 | | 1/1998 |
| WO | WO00-002183 | | 1/2000 |
| WO | WO02-047061 | | 6/2002 |

OTHER PUBLICATIONS

Hajime Washio et al.; "TFT-LCDs with Monolithic Multi-Drivers for High Performance Video and Low-Power Text Modes"; *SID 01 Digest*; pp. 276-279; 2001.

* cited by examiner

DISPLAY DEVICE AND ELECTRIC EQUIPMENT USING THE SAME

BACKGROUND OF THE INVENTION

1. Field of the Invention

The present invention relates to a display device in which a light emitting element is provided on an insulting surface, the present invention particularly relates to an active matrix display device having a plurality of pixels arranged in matrix, and in each pixel a light emitting element is arranged. Further, the present invention relates to electronic apparatuses applying the display device.

2. Description of the Related Art

An active matrix display device having a plurality of pixels in which a switching element and a light emitting element are arranged in each pixel, comes under the spotlight.

For the light emitting element arranged in each pixel, an OLED (organic light emitting diode) device has OLEDs included in is described as an example.

In this specification, an OLED denotes a configuration having an anode, a cathode, and an organic component layer sandwiched between the anode and the cathode. The anode and the cathode correspond to a first and a second electrode, respectively. Then, an OLED emits light by applying a voltage between electrodes.

An organic compound layer usually has a laminate structure. A typical laminate structure thereof is one proposed by Tang et al. of Eastman Kodak Company and consisting of a hole transporting layer, a light emitting layer, and an electron transporting layer. Other examples of the laminate structure include one in which a hole injection layer, a hole transporting layer, a light emitting layer, and an electron transporting layer are layered in order on an anode, and one in which a hole injection layer, a hole transporting layer, a light emitting layer, an electron transporting layer, and an electron injection layer are layered in order on an anode. A light emitting layer may be doped with a fluorescent pigment or the like.

In this specification, all layers provided between the anode and the cathode generally are called an organic compound layer. The above-mentioned hole injection layer, hole transporting layer, light emitting layer, electron transporting layer, electron injection layer, and other layers are all included in the organic compound layer.

A given voltage is applied to an organic compound layer structured as above from a pair of electrodes (an anode and a cathode) to induce recombination of carriers in its light emitting layer. As a result, the light emitting layer emits light. Note that in this specification, emitting an OLED is referred to as driving an OLED.

An OLED in this specification refers to an OLED that uses a singlet exciton to emit light (fluorescent light), an element that uses a triplet exciton to emit light (phosphorescent light), or an OLED that uses the both.

Further, any one of a low molecular material, a high molecular material, and an intermediate molecular material can be a material for an organic compound layer of OLED.

Note that an intermediate molecular material in this specification denotes a material without sublimeness and the length of a chain of its molecular is 10 μm or less.

An OLED display device has advantages like superiority in response, capable of operation with a low voltage and a wide view angle, etc. Therefore, the OLED display device comes under the spotlight as a next generation flat panel display.

FIG. 7 shows a schematic structure of an active matrix OLED display device.

Assume that a video signal inputted to a display device in this specification is a digital signal (hereinafter referred to as digital video signal).

In FIG. 7, a display device includes a pixel portion 704 having a plurality of pixels arranged in matrix, a signal line driver circuit 701, a scanning line driver circuit 703, and a signal control circuit 702.

Note that the signal control circuit 702 may be integrally formed on a substrate in which the pixel portion 704 is formed, or may be formed on a single crystalline IC substrate and mounted on the substrate in which the pixel portion 704 is formed.

A digital video signal (video signal) inputted from the outside of the display device is temporarily stored in the signal control circuit 702. After that, the digital video signal is read out from the signal control circuit 702 and inputted to the signal line driver circuit 701.

The signal line driver circuit 701 takes the digital video signal and outputs a video signal to a plurality of signal lines provided to the pixel portion 704. In addition, the scanning line driver circuit 703 inputs signals to a plurality of scanning lines provided to the pixel portion 704.

A specific pixel row is selected by the signals inputted to the plurality of scanning lines. Here, assume that the selection of the pixel row indicates that a pixel row is in a state in which the video signals outputted to the respective signal lines can be inputted to the respective pixels.

Thus, light emission of light emitting elements in the respective pixels is controlled according to the video signals inputted to the respective pixels by the signal line driver circuit 701 and the scanning line driver circuit 703.

Note that the video signal may be an analog signal or a digital signal. Further, the video signal may be a voltage signal or a current signal.

When an analog video signal is inputted, the light emitting element in each pixel emits light at an intensity corresponding to the inputted analog video signal, thereby representing a gray scale.

On the other hand, in the pixel to which the digital video signal is inputted, a light emitting state or a non-light emitting state of the light emitting element is selected. At this time, in each pixel, a period for which the light emitting state is selected is controlled to represent a gray scale (time gray scale method). Alternatively, in each pixel, an area which becomes the light emitting state is controlled to represent a gray scale (area gray scale method).

Structural examples of the signal line driver circuit 701 and the signal control circuit 702 as shown in FIG. 7 will be described below.

FIG. 8 is a block diagram showing structures of the signal line driver circuit 701 and the signal control circuit 702 as shown in FIG. 7.

In FIG. 8, the signal line driver circuit 701 is constructed to output an analog signal as a video signal.

Note that an example in which digital video signals inputted to the signal line driver circuit 701 are signals of 6 bits is indicated. In addition, the digital video signals of 6 bits are inputted for every bit from the signal control circuit 702 through six wirings (VD1, VD2, VD3, VD4, VD5, and VD6). Here, a wiring to which the digital video signal of a p-th (where p is a natural number of 1 to 6) bit is inputted is indicated by VDp.

FIG. 6 shows a list order of the digital video signals inputted to the signal line driver circuit 701 through the wirings VD1 to VD6. Note that SD (i, j)_g indicates a g-th bit signal for a pixel at i-th row and j-th column in FIG. 6.

During a period TA (1, 1), signals SD (1, 1)_1 to SD (1, 1)_6 are simultaneously inputted to the respective wirings VD1 to VD6. Thus, 6-bit signals for the pixel at 1st row and 1st column are inputted to the wirings VD1 to VD6 during the period TA (1, 1). Such operation is conducted during all periods TA (1, 1) to TA (y, x) so that the 6-bit signals corresponding to all the pixels are inputted to the wirings VD1 to VD6.

Note that the display device has pixels of y-row and x-column.

Also, in FIG. 8, the signal control circuit 702 has a CPU 801, a frame memory A 803, a frame memory B 804, a memory controller 805 for controlling reading of the signal from and writing of the signal into the frame memory A 803 and the frame memory B 804, and a display controller 802 for outputting a control signal such as a clock signal inputted to the signal line driver circuit 701 and the scanning line driver circuit 703.

The frame memory A 803 and the frame memory B 804 each have a capacity capable of storing digital video signals corresponding to a frame.

The digital video signals inputted to the display device are temporarily stored in the frame memory A 803 in response to signals from the CPU 801 and the memory controller 805. The digital video signals stored in the frame memory A 803 are read therefrom for every bit in response to signals from the CPU 801 and the memory controller 805 and outputted to the wirings VD1 to VD6.

Note that, while the digital video signals stored in the frame memory A 803 are read, digital video signals corresponding to a next frame are stored in order in the frame memory B 804. Thus, the frame memory A 803 and the frame memory B 804 are alternately used. Accordingly, the storage and the read and write of the digital video signal can be efficiently conducted.

The digital video signals inputted to the signal line driver circuit 701 are held in a first latch circuit 502 in response to a sampling pulse from a shift register 501. When the digital video signals corresponding to one pixel row are held in the first latch circuit 502, a latch pulse is inputted to a second latch circuit 503. Thus, the second latch circuit 503 holds the digital video signals corresponding to one pixel row which are held in the first latch circuit 502 at a time.

The digital video signals held in the second latch circuit 503 are inputted to a D/A converting circuit 504. The digital video signals inputted to the D/A converting circuit 504 are converted into analog signals and outputted as video signals to respective signal lines S1 to Sx.

A circuit example of the signal line driver circuit 701 having the structure shown in FIG. 8 is shown in a circuit diagram of FIG. 5. In FIG. 5, the same portion as in FIG. 8 is indicated using the same reference symbols and the description thereof is omitted here.

In FIG. 5, a portion 502_1 of the first latch circuit 502, a portion 503_1 of the second latch circuit 503, and a portion 504_1 of the D/A converting circuit 504 which correspond to a first signal line S1 are shown for a typical example.

A clock pulse S_CLK and an inverted clock pulse S_CLKB obtained by inverting a polarity of the clock pulse are inputted to the shift register 501. When a start pulse S_SP is inputted to the shift register 501, it outputs a sampling pulse to wirings 511_1 to 511_x.

When the sampling pulse outputted from the shift register 501 is inputted to the wiring 511_1, respective blocks 502*a*_1 to 502*a*_6 included in the portion 502_1 of the first latch circuit hold the digital video signals inputted to the wirings VD1 to VD6.

The sampling pulse is inputted in order to the wirings 511_1 to 511_x and the first latch circuit 502 holds the digital video signals corresponding to one pixel row.

After that, a latch pulse LP and an inverted latch pulse LPB obtained by inverting a polarity of the latch pulse LP are inputted to the second latch circuit 503. Then, respective blocks 503*a*_1 to 503*a*_6 in the portion 503_1 of the second latch circuit hold the digital video signals which are held in the blocks 502*a*_1 to 502*a*_6 of the portion 502_1 of the first latch circuit at a time.

The digital video signals of 6 bits which are held in the portion 503_1 of the second latch circuit are inputted to the portion 504_1 of the D/A converting circuit through wirings $S_{1d}$_1 to $S_{1d}$_6, converted into analog signals, and outputted to the signal line S1.

Such operation is conducted by the second latch circuit 503 and the D/A converting circuit 504 which correspond to all the signal lines S1 to Sx. Thus, the video signals are outputted to all the signal lines S1 to Sx.

Note that, when the second latch circuit 503 holds the digital video signals corresponding to one pixel row, the first latch circuit 502 starts to hold digital video signals corresponding to a next pixel row.

Such operation is conducted for digital video signals corresponding to all pixel rows, and the digital video signals of 6 bits corresponding to all the pixels are outputted.

Thus, the output of the analog video signals corresponding to a frame to the signal lines S1 to Sx is completed.

Here, it is desirable that the display device is operated at low power consumption. Particularly, it is strongly desirable that a display device mounted in a portable information device has low power consumption.

Also, multi gray scale display is not always required for an image to be displayed on the display device. For example, display in which the number of gray scales is reduced is sufficient for an idle screen of a mobile telephone or the like.

Therefore, an attempt is being made to reduce the number of bits of the signals of the signals used for gray scale display, of the digital video signals inputted to the display device in accordance with a set by a user, thereby reducing the power consumption of the display device.

Hereinafter, an example of a driving method in the case where the number of bits used for gray scale display is reduced and the signal line driver circuit shown in FIG. 5 is operated will be described.

Note that an example in the case where gray scale is represented using the upper 2 bits of a digital video signal is indicated here.

The digital video signals are inputted to the signal line driver circuit through the wirings VD1 to VD6. However, a structure is employed in which the D/A conversion is conducted using only the upper 2-bit signals inputted to the wirings VD1 and VD2 by the D/A converting circuit 504 and analog signals are outputted.

The case of a structure in which the D/A converting circuit 504 has a plurality of gray scale power source lines each set to voltages corresponding to gray scales is considered as an example. When an intensity is represented using the digital video signals of the upper 2 bits, the supply of voltages to the gray scale power source lines corresponding to the lower 4-bit signals which are not used for gray scale representation is stopped.

Thus, the display in which the number of bits of the digital video signals used for gray scale display is reduced can be conducted.

Also, in the example of the above driving method, only the upper 2 bits of the digital video signals are read from the frame memory of the signal control circuit. According to such a driving method, the number of read operations of the frame memory in the signal control circuit can be reduced.

Thus, the display in which the number of bits of the digital video signals used for gray scale display is reduced can be conducted.

According to the display device having the signal line driver circuit 701 as shown in FIGS. 5, 7, and 8 in the conventional example, even when the number of gray scales is reduced and display is conducted, the shift register 501 included in the signal line driver circuit 701 operates at the same frequency.

Also, in the first latch circuit 502 and the second latch circuit 503 which are included in the signal line driver circuit 701, blocks corresponding to the lower bits which are not used for gray scale display also operate in response to the sampling pulse from the shift register and the latch pulse, as in the case of general gray scale representation of 6 bits.

Accordingly, there is a problem in that power consumption in the case where the number of gray scales is reduced and the gray scale display is conducted cannot be greatly reduced as compared with power consumption in the case where the 6-bit gray scale display is conducted.

SUMMARY OF THE INVENTION

Therefore, an object of the present invention is to provide a display device which can operate at low power consumption.

In order to solve the above problem of prior art, the following means are used for the present invention.

A display device of the present invention has both of a first signal line driver circuit to which digital video signals of n bits are inputted and which outputs video signals to a pixel portion and a second signal line driver circuit to which digital video signals of m (where m is a natural number smaller than n) bits are inputted and which outputs video signals to the pixel portion.

For example, the first signal line driver circuit is constructed to hold the digital video signals of n bits corresponding to one row of a plurality of pixels arranged in matrix in the pixel portion. In addition, the second signal line driver circuit is constructed to hold the digital video signals of m bits corresponding to one row of a plurality of pixels arranged in matrix in the pixel portion.

Alternatively, a drive frequency of the second signal line driver circuit is made smaller than that of the first signal line driver circuit.

Thus, when multi gray scale display is conducted and when display in which the number of gray scales is reduced is conducted, the signal line driver circuits having different structures are provided according to the respective cases.

Also, it is constructed to switch between the connection between the first signal line driver circuit and a plurality of signal lines and the connection between the second signal line driver circuit and the plurality of signal lines.

Thus, the first signal line driver circuit and the second signal line driver circuit are separately used to conduct the display.

According to the above structure, the signal line driver circuit having the structure according to the number of gray scales to be represented is used to conduct the display. Thus, redundant power consumption can be prevented in the display device.

Note that, when multi gray scale display is conducted or when display in which the number of gray scales is reduced is conducted, the read operation of the digital video signal from the frame memory of the signal control circuit is also changed according to the respective cases.

For example, the present invention has a structure such that the signal control circuit includes: means for holding n-bit signals of the video signal, reading the held n-bit signals in order, outputting the read n-bit signals as the digital video signals of the n bits; means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

Further, a scanning line driver circuit has a structure capable of selecting a plurality of scanning lines for inputting signals to the plurality of pixels in an arbitrary order. In other words, the scanning line driver circuit has the structure capable of selecting each pixel row of the plurality of pixels arranged in matrix in the pixel portion in an arbitrary order.

For example, a decoder is used as the scanning line driver circuit.

Thus, the pixel rows are selected in an arbitrary order. Therefore, it is constructed that a region displayed by the first signal line driver circuit or a region displayed by the second signal line driver circuit can be selected in a frame.

Accordingly, a region for which multi gray scale display is required and a region for which display in which the number of gray scales is reduced is sufficient are selected in one frame so that power consumption can be effectively reduced.

Note that, it is constructed such that, of the plurality of pixels, a pixel to which a video signal is inputted can be arbitrarily set by the first signal line driver circuit or the second signal line driver circuit and the scanning line driver circuit.

Thus, a region for which display is required and a region for which display is not conducted are selected in one frame so that power consumption can be effectively reduced.

The plurality of pixels arranged in matrix, which compose the pixel portion of the display device according to the present invention each have a light emitting element.

Here, the plurality of pixels may be arranged by an area color mode.

Assume that a light emitting element in this specification indicates an element for emitting light at an intensity corresponding to a flowing current or an element for emitting light at an intensity corresponding to an applied voltage.

As an example of the light emitting element, there is an element using an electron source element which is represented by an EL element, an FE (field emission) element, or an MIM (metal-insulator-metal) element.

Note that an element for emitting an electron by a field effect is called an electron source element in this specification. The electron source element is called a light emitting element obtained by combining light emitters such as phosphors.

Note that the present invention may be an electronic equipment using the display device having the above structure.

DETAILED DESCRIPTION OF THE PREFERRED EMBODIMENTS

An embodiment mode of the present invention will be described below.

Figure 1:
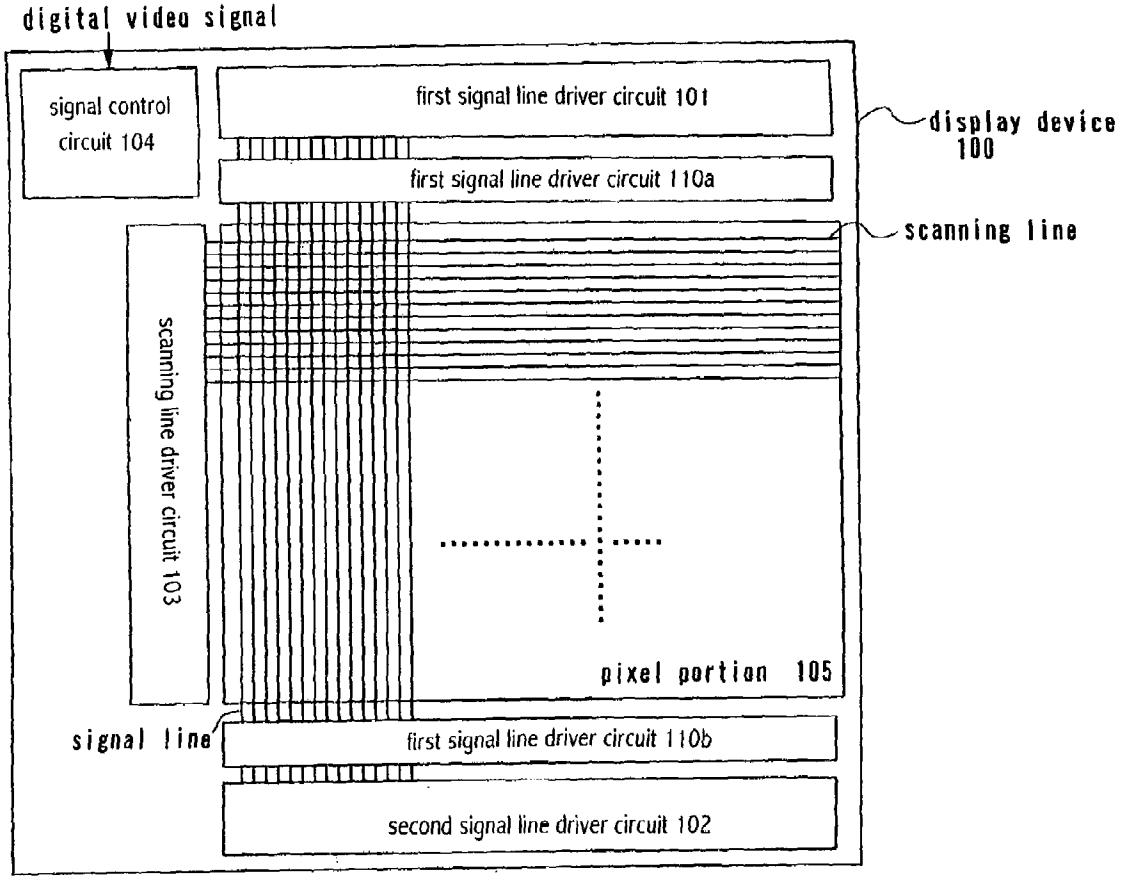
FIG. 1 is a block diagram of a display device of the present invention.

FIG. 1 is a block diagram of a display device of the present invention.

Note that an example in which a video signal inputted to a signal line of a pixel is an analog signal is indicated in this embodiment mode.

In FIG. 1, a display device 100 has a scanning line driver circuit 103, a first signal line driver circuit 101, a second signal line driver circuit 102, a signal control circuit 104, and switching circuits 110*a* and 110*b* in the vicinity of a pixel region 105.

Note that the signal control circuit 104 may be integrally formed on a substrate in which the pixel portion 105 is formed, or may be formed on a single crystalline IC substrate and mounted on the substrate in which the pixel portion 105 is formed.

In this embodiment mode, the first signal line driver circuit 101 is a circuit to which digital video signals of 6 bits are inputted, which converts the inputted digital video signals of 6 bits into corresponding analog signals, and which outputs them to signal lines. In addition, the second signal line driver circuit 102 is a circuit to which a digital video signal of the upper 1 bit is inputted, which converts the inputted digital video signal of the upper 1 bit into a corresponding analog signal, and which outputs it to signal lines.

Figure 5:
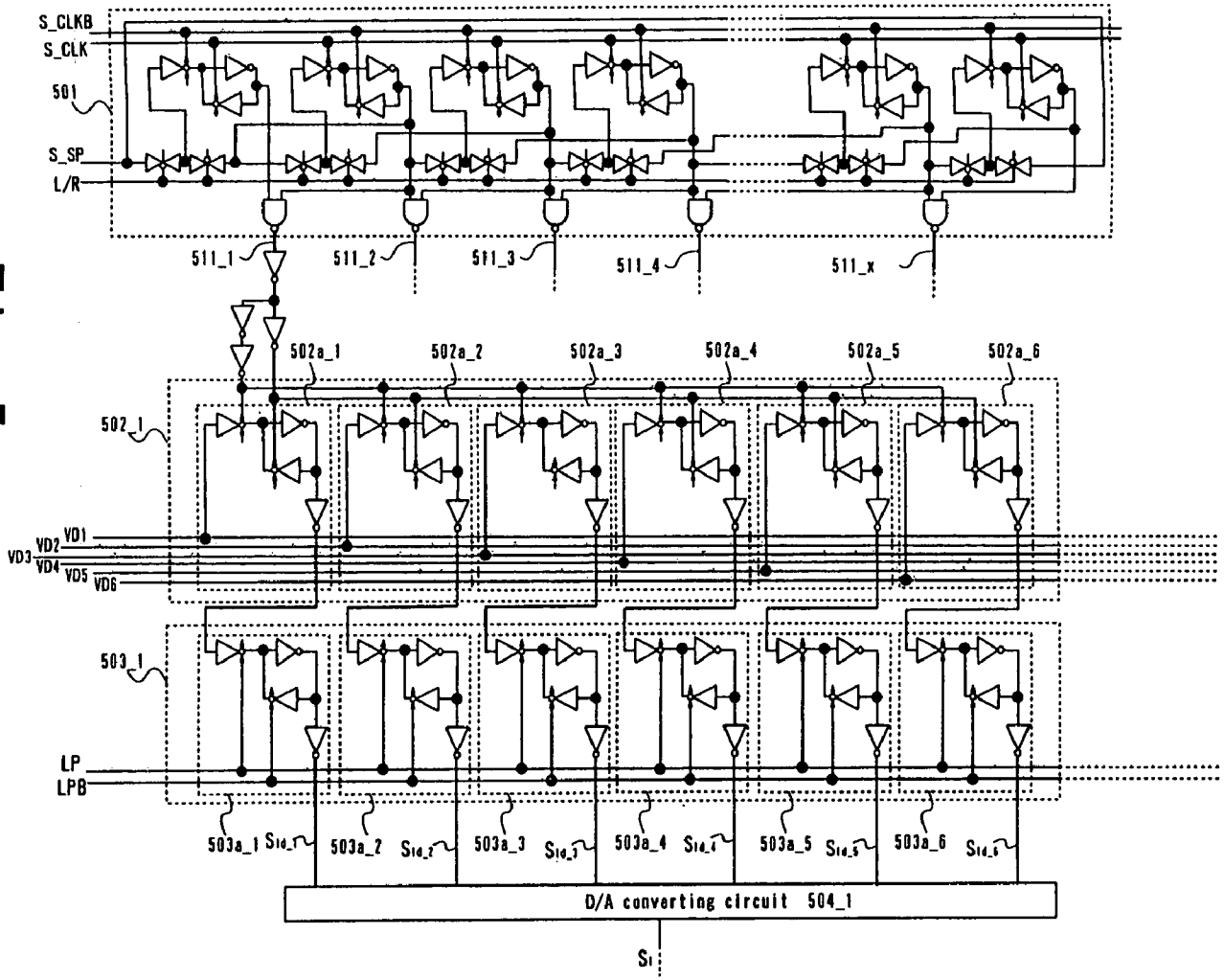
Fig. 5 PRIOR ART
FIG. 5 is a circuit diagram showing the configuration of a conventional signal line driver circuit.

The first signal line driver circuit 101 can be made to have the same structure as in the conventional example shown in FIG. 5 and driven by the same driving method. The description is omitted here.

The output of the first signal line driver circuit 101 of this embodiment mode is not shown in FIG. 5. However, it is outputted to the signal lines S1 to Sx in the pixel portion 105 through the switching circuit 110*a*.

Figure 2:
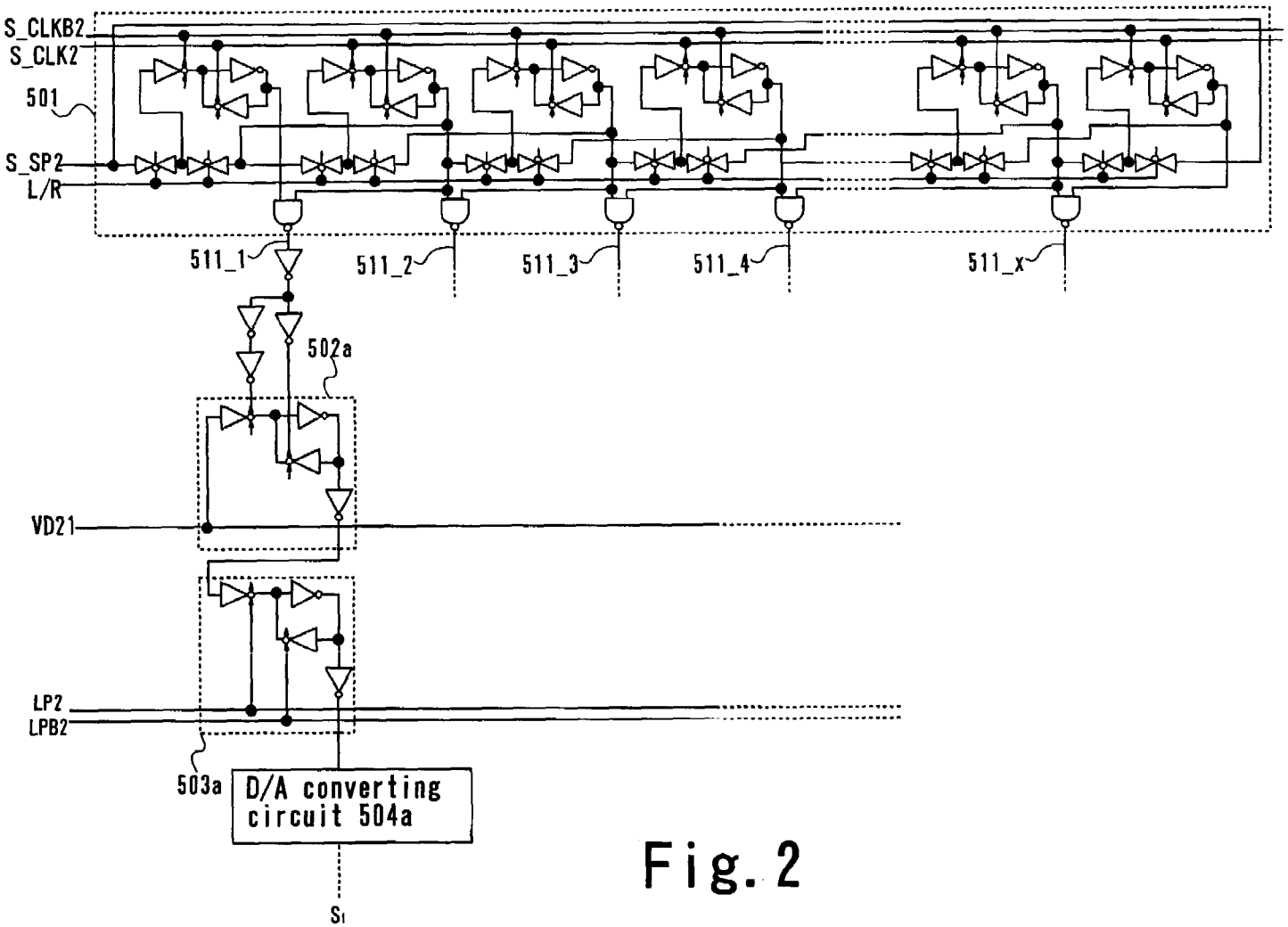
FIG. 2 is a circuit diagram showing the configuration of a signal line driver circuit.

FIG. 2 shows a structure of the second signal line driver circuit 102. Note that, in FIG. 2, the same portions as in FIG. 5 are indicated using the same reference numerals.

The second signal line driver circuit 102 has a shift register 501, a first latch circuit 502, a second latch circuit 503, and a D/A converting circuit 504.

In FIG. 2, a portion 502*a* of the first latch circuit 502, a portion 503*a* of the second latch circuit 503, and a portion 504*a* of the D/A converting circuit 504 which correspond to the first signal line S1 are shown for a typical example.

A method of driving the second signal line driver circuit having the structure shown in FIG. 2 will be described below.

A clock pulse S_CLK2 and an inverted clock pulse S_CLKB2 obtained by inverting a polarity of the clock pulse are inputted to the shift register 501. When a start pulse S_SP2 is inputted to the shift register 501, it outputs a sampling pulse to wirings 511_1 to 511_x.

When the sampling pulse outputted from the shift register 501 is inputted to the wiring 511_1, the portion 502*a* of the first latch circuit holds the digital video signal of the upper 1 bit inputted to the wiring $VD_2$1 .

The sampling pulse is inputted in order to the wirings 511_1 to 511_x and the first latch circuit 502 holds the digital video signals corresponding to one pixel row.

After that, a latch pulse LP2 and an inverted latch pulse LPB2 obtained by inverting a polarity of the latch pulse LP2 are inputted to the second latch circuit 503. Then, the portion 503*a* of the second latch circuit 503 holds the digital video signal held in the portion 502*a* of the first latch circuit.

The digital video signal of 1 bit which is held in the portion 503*a* of the second latch circuit 503 is inputted to the portion 504*a* of the D/A converting circuit, converted into a corresponding video signal, and outputted to the signal line S1.

Such operation is conducted by the second latch circuit 503 and the D/A converting circuit 504 which correspond to all the signal lines S1 to Sx. Thus, the video signals are outputted to all the signal lines S1 to Sx.

Note that, when the second latch circuit 503 holds the digital video signals corresponding to one pixel row, the first latch circuit 502 starts to hold digital video signals corresponding to a next pixel row.

Such operation is conducted for digital video signals corresponding to all pixel rows, and the video signals of 1 bit corresponding to all the pixels are outputted.

Thus, the output of the digital video signals corresponding to the frame is completed.

The output of the second signal line driver circuit 102 of this embodiment mode is not shown in FIG. 2. However, it is outputted to signal lines S1 to Sx in the pixel portion 105 through the switching circuit 110*b*.

Thus, the first signal line driver circuit 101 and the second signal line driver circuit 102 each are constructed according to the number of gray scales to be represented.

Whether the output of the first signal line driver circuit 101 is outputted to the signal lines S1 to Sx or whether the output of the second signal line driver circuit 102 is outputted thereto is selected by the switching circuits 110*a* and 110*b*.

Accordingly, when the first signal line driver circuit 101 and the second signal line driver circuit 102 are separately used, redundant power consumption can be prevented in the display device.

Next, a detailed structure of the signal control circuit 104 shown in FIG. 1 will be described.

Figure 3:
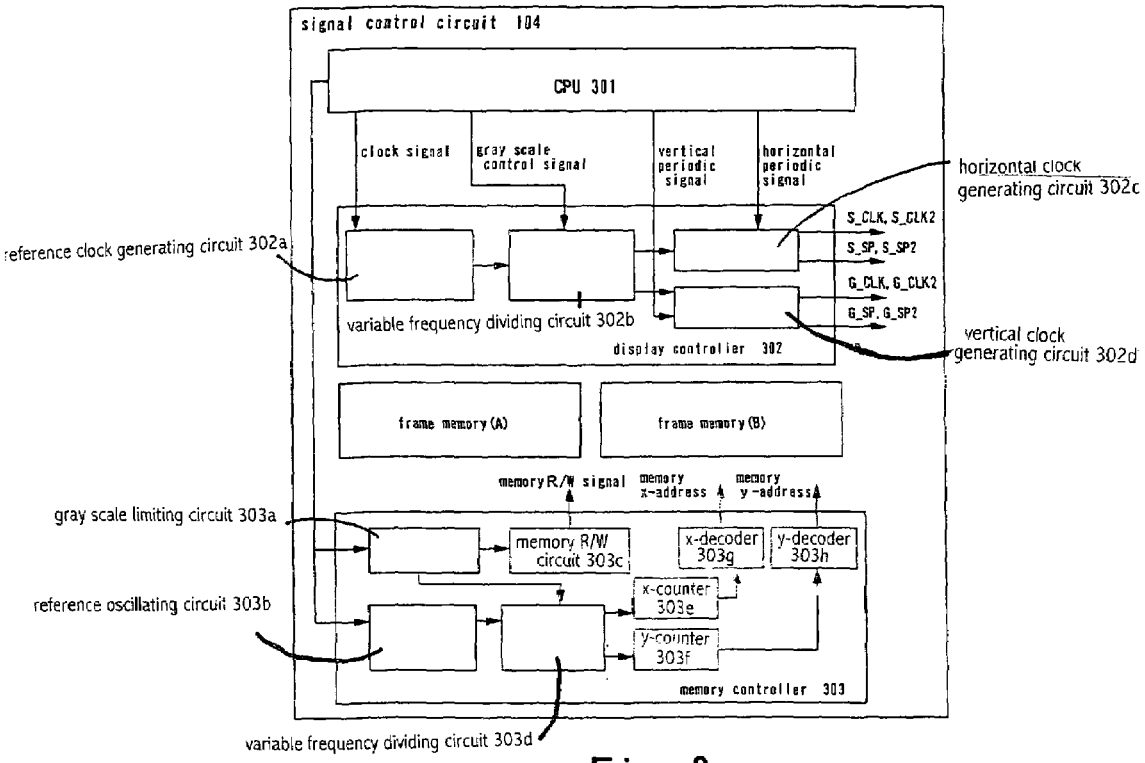
FIG. 3 is a view which shows the configuration of a signal control circuit.

FIG. 3 is a block diagram showing the structure of the signal control circuit 104.

The signal control circuit 104 has a CPU 301, a frame memory A, a frame memory B, a memory controller 303 for controlling signal write into and signal read from the frame memory A and the frame memory B, and a display controller 302 for outputting control signals to be inputted to the signal line driver circuits and the scanning line driver circuit.

The frame memory A and the frame memory B each have a capacity capable of storing digital video signals corresponding to a frame.

The memory controller 303 has a gray scale limiting circuit 303*a*, a memory R/W circuit 303*c*, and a reference oscillating circuit 303*b*, a variable frequency dividing circuit 303*d*, an x-counter 303*e*, a y-counter 303*f*, an x-decoder 303*g*, and a y-decoder 303*h*.

Also, the display controller 302 has a reference clock generating circuit 302*a*, a variable frequency dividing circuit 302*b*, a horizontal clock generating circuit 302*c*, and a vertical clock generating circuit 302*d*.

Here, a method of driving the signal control circuit 104 will be described.

First, the operation of the memory controller 303 will be described.

The gray scale limiting circuit 303*a* to which a signal from the CPU 301 is inputted outputs a signal according to a gray scale to be represented. An output signal of the gray scale limiting circuit 303*a* is inputted to the memory R/W circuit 303*c* for controlling the read and write of the digital video signal from and into the memory (frame memory A or frame memory B). Thus, the memory R/W circuit 303*c* outputs a memory R/W signal for controlling the read and write of the digital video signal from and into the memory according to the number of gray scales to be represented.

Also, the signal from the CPU 301 is simultaneously inputted to the reference oscillating circuit 303*b*. A signal from the reference oscillating circuit 303*b* is inputted to the variable frequency dividing circuit 303*d*. The variable frequency dividing circuit 303*d* changes frequencies of output signals according to the signal from the gray scale limiting circuit 303*a*. The signals which is outputted from the variable frequency dividing circuit 303*d* are inputted to the x-counter 303*e* and the y-counter 303*f*. The x-decoder 303*g* designates an x-address of the memory (memory x-address) according to a signal from the x-counter 303*e*. In addition, the y-decoder 303*h* designates a y-address of the memory (memory y-address) according to a signal from the y-counter 303*f*.

Thus, the digital video signals inputted to the display device are temporarily stored in the frame memory A according to the signal from the CPU 301, and the memory R/W signal, the memory x-address, and the memory y-address which are outputted from the memory controller 303.

After that, the digital video signals stored in the frame memory A are read for every bit according to the signal from the CPU 301, and the memory R/W signal, the memory x-address, and the memory y-address which are outputted from the memory controller 303.

Note that, while the digital video signals stored in the frame memory A are read, digital video signals corresponding to a next frame are stored in order in the frame memory B. Thus, the frame memory A and the frame memory B are alternately used. Accordingly, the storage and read of the digital video signal can be efficiently conducted.

Figure 6:
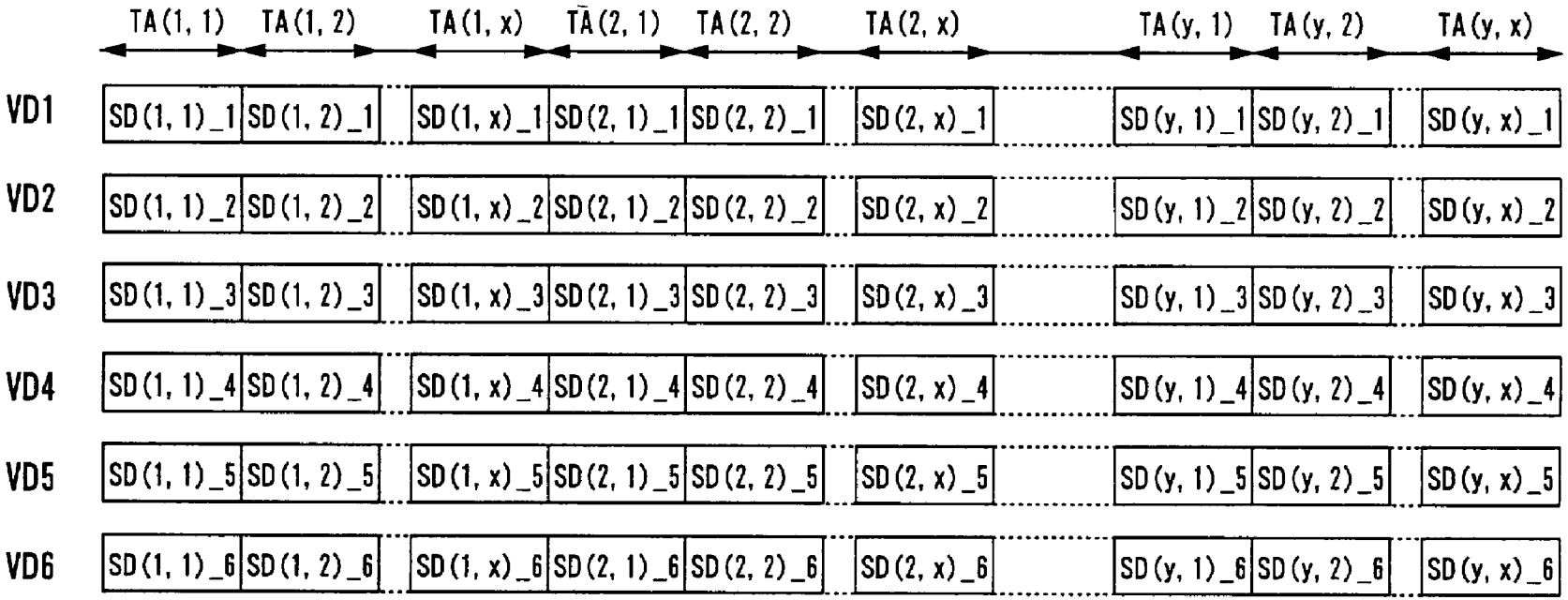
FIG. 6 is a diagram showing digital video signals in order of output.
Figure 7:
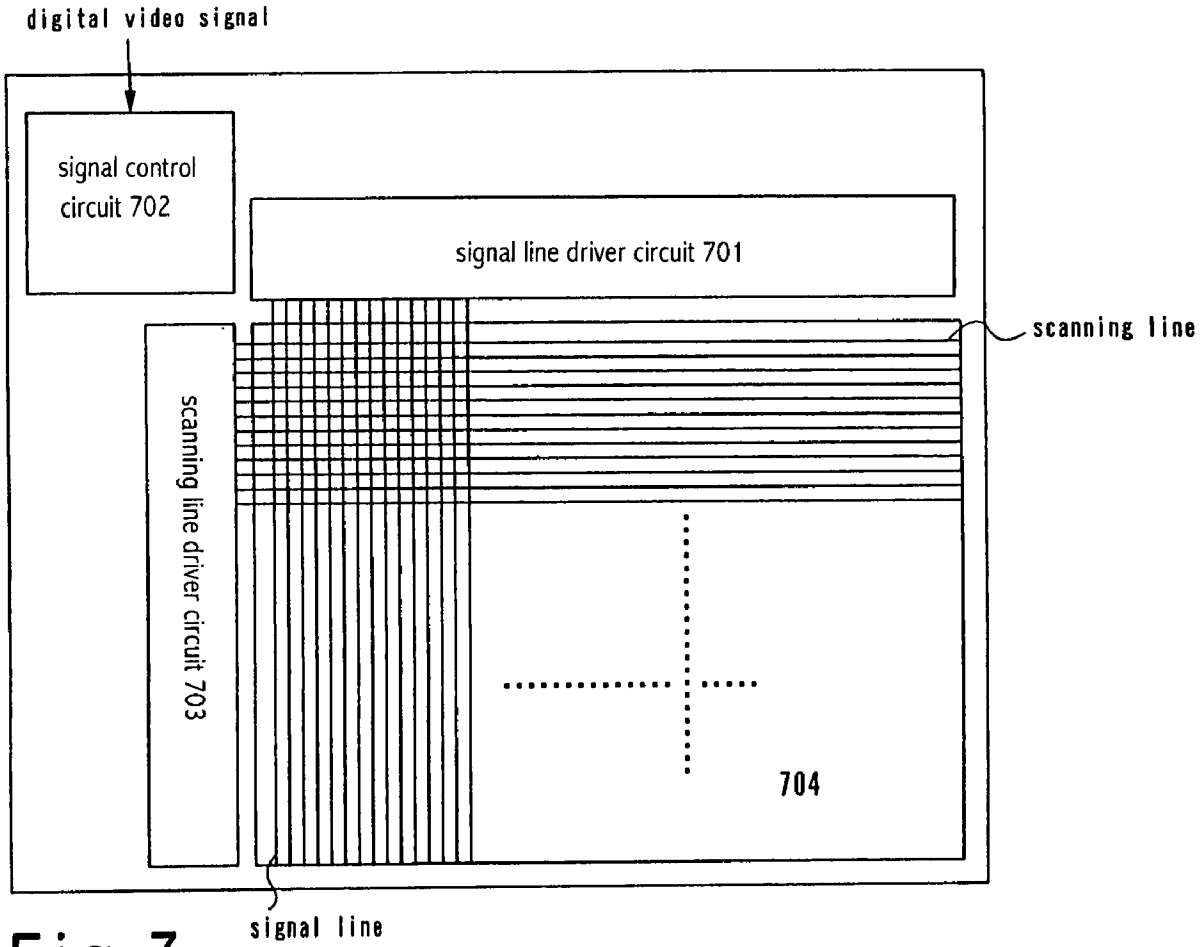
Fig. 7 PRIOR ART
FIG. 7 is a block diagram of the conventional display device.
Figure 8:
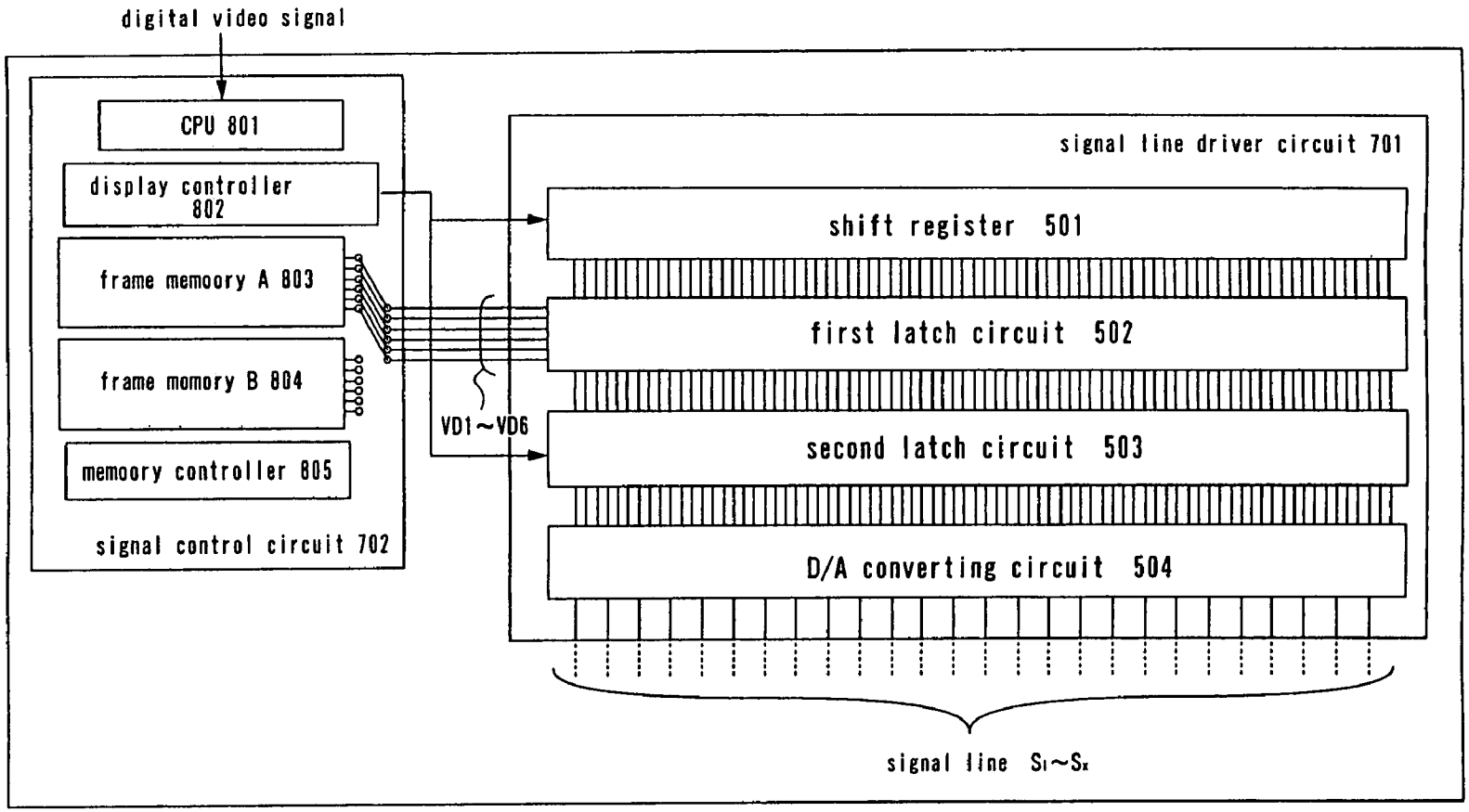
Fig. 8 PRIOR ART
FIG. 8 is a block diagram of a conventional signal line driver circuit and a conventional signal control circuit.

When 6-bit display is selected by the memory controller 303 having the above structure, the signals obtained by arranging the digital video signals of 6 bits for every bit as shown in FIG. 6 are outputted to the wirings VD1 to VD6.

On the other hand, when 1-bit display is selected, the memory R/W signal, the memory x-address, and the memory y-address are changed in response to the signal inputted from the CPU 301 to the memory controller 303. Thus, the write of the digital video signal into the memory is conducted for only 1 bit. In addition, the read of the digital video signal from the memory is conducted for only 1 bit. Accordingly, the digital video signal of 1 bit is outputted to the wiring $VD_2$1.

When the display in which the number of gray scales is reduced is conducted by the structure of the above memory controller 303, it is possible that the number of operations of the storage and read of the digital video signal in and from the memory (frame memory A or frame memory B) is reduced, thereby decreasing the power consumption of the signal control circuit 104.

Also, a clock signal, a horizontal periodic signal, a vertical periodic signal, and a gray scale control signal are inputted from the CPU 301 to the display controller 302. The clock signal is inputted to the reference clock generating circuit 302*a* so that it outputs a reference clock. The outputted reference clock is inputted to the variable frequency dividing circuit 302*b*. The variable frequency dividing circuit 302*b* outputs a clock signal corresponding to a gray scale based on the inputted reference clock in accordance with the gray scale control signal. The horizontal clock generating circuit 302*c* outputs the clock signals and the start pulses, etc., to the respective signal line driver circuits (first signal line driver circuit and second signal line driver circuit) in accordance with the clock signal outputted from the variable frequency dividing circuit 302*b*.

When the 6-bit display is selected in accordance with the gray scale control signal, the display controller 302 inputs the clock signal S_CLK and the start pulse S_SP to the first signal line driver circuit. In addition, when the 1-bit display is selected in accordance with the gray scale control signal, the display controller 302 inputs the clock signal S_CLK2 and the start pulse S_SP2 to the second signal line driver circuit.

Also, the vertical clock generating circuit 302*d* generates the clock signal and the start pulse to be inputted to the scanning line driver circuit in accordance with the clock signal outputted from the variable frequency dividing circuit 302*b*.

When the 6-bit display is selected in accordance with the gray scale control signal, the display controller 302 inputs the clock signal G_CLK and the start pulse G_SP to the scanning line driver circuit. In addition, when the 1-bit display is selected in accordance with the gray scale control signal, the display controller 302 inputs the clock signal G_CLK2 and the start pulse G_SP2 to the scanning line driver circuit.

In this embodiment mode, according to the structures of the first signal line driver circuit and the second signal line driver circuit as shown in FIGS. 5 and 2, the frequencies of the clock signal S_CLK and the clock signal S_CLK2 which each are inputted thereto are the same. In addition, when the 6-bit display is conducted and when the 1-bit display is conducted, the frequencies of clock signals G_CLK and G_CLK2 which are inputted to the scanning line driver circuit are the same. However, the drive frequencies of the respective signal line driver circuits and the scanning line driver circuit can be changed by the display controller 302 having the above structure.

Note that the example in which the first signal line driver circuit to which the digital video signals of 6 bits are inputted and which outputs the video signals and the second signal line driver circuit to which the digital video signal of 1 bit is inputted and which outputs the video signal are provided is indicated in this embodiment mode. However, the display device of the present invention is not limited to such a structure. Generally, the display device of the present invention can be constructed to have the first signal line driver circuit to which the digital video signals of n (where n is a natural number) bits are inputted and which outputs the video signals and the second signal line driver circuit to which the digital video signals of m (where m is a natural number smaller than n) bits are inputted and which outputs the video signals.

In addition to the first signal line driver circuit and the second signal line driver circuit, it may be constructed to have a third signal line driver circuit to which digital video signals of k (where k is a natural number smaller than n and different from m) bits are inputted and which outputs video signals. Thus, when an arbitrary number of signal line driver circuits are provided and selectively used, a reduction in power consumption of the display device can be realized.

Note that the analog video signal may be a voltage signal or a current signal. For example, when the voltage signal is used as the analog video signal, it is preferable that a D/A converting circuit to which a digital signal is inputted and which outputs an analog voltage signal (hereinafter referred to as voltage output type D/A converting circuit) is used. On the other hand, when the current signal is used as the analog video signal, it is preferable that a D/A converting circuit to which a digital signal is inputted and which outputs an analog current signal (hereinafter referred to as current output type D/A converting circuit) is used.

Also, a decoder can be used as the scanning line driver circuit 103 shown in FIG. 1. Thus, pixel rows can be selected in an arbitrary order. Accordingly, a region displayed by the first signal line driver circuit 101 and a region displayed by the second signal line driver circuit 102 can be selected in a frame.

Figure 4:
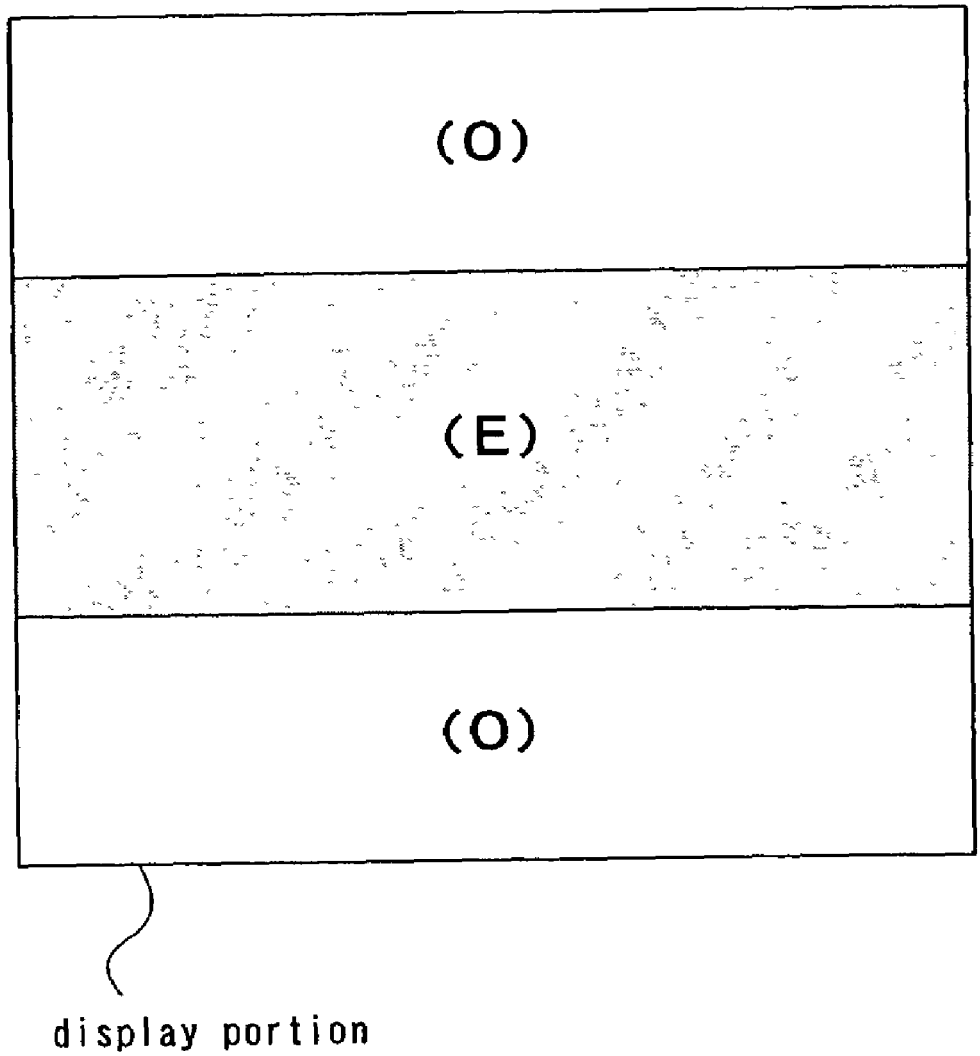
FIG. 4 is a view showing a frame format of a technique of an image display of the present invention.

For example, as shown in FIG. 4, it can be constructed that a video signal is inputted to a pixel in a region (E) of a display portion by using the second signal line driver circuit 102 and a video signal is inputted to pixels in regions except the region (E) (regions (0)) by using the first signal line driver circuit 101.

Therefore, it is possible that the display in which the number of gray scales is reduced is conducted for the region (E) and the general multi gray scale display is conducted for the regions (0).

Also, according to the structure of the present invention, a video signal can be inputted to only a pixel in a portion of the pixel portion (display portion). Thus, an image can be displayed in the portion of the pixel portion.

By the above method, an area of a region of the display device on which an image is displayed can be arbitrarily changed.

Embodiment 1

In this embodiment, an example in which the present invention is applied to a display device in which digital video signals are inputted to signal lines to represent a gray scale is indicated.

In this embodiment, an example in the case where display is conducted using a time gray scale method is indicated.

According to the time gray scale method, a frame period for displaying an image is divided into a plurality of subframe periods. During each of the plurality of subframe periods, a light emitting state or a non-light emitting state is selected for each pixel in accordance with the inputted digital video signal. Thus, a gray scale is represented in a pixel in accordance with the total of light emitting periods of subframe periods for which the light emitting state is selected during a single frame period.

Figure 9:
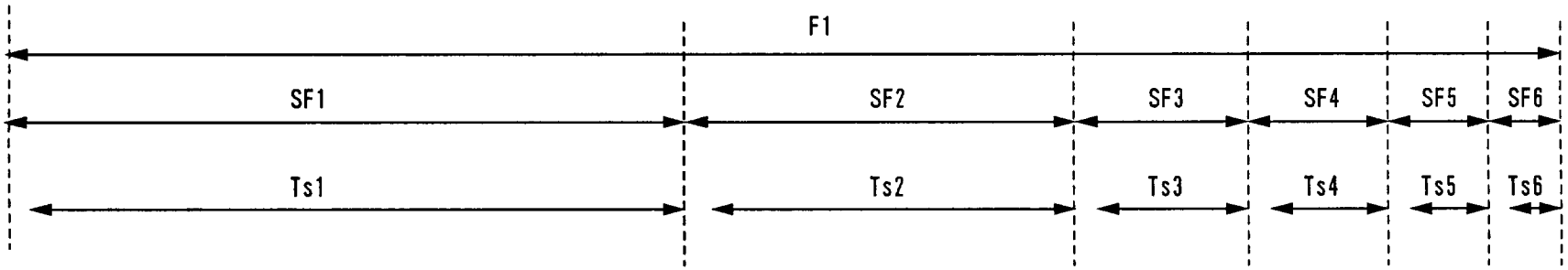
FIG. 9 is a diagram showing a driving method of a time gray scale method.

FIG. 9 is a schematic view showing a method of driving a display device for displaying an image using a time gray scale method. In FIG. 9, first to sixth subframe periods SF1 to SP6 corresponding to respective bits of digital video signals of 6 bits are provided.

With respect to the respective subframe periods SF1 to SP6, a period for which a light emitting state or a non-light emitting state of a light emitting element for each pixel is selected is called a display period and referred to as Ts. Here, generally, a display period of the first subframe period SF1 is given as Ts1. For example, lengths of display periods Ts1:Ts2:Ts3:Ts4:Ts5:Ts6 set to by $2^0:2^{-1}:2^{-2}:2^{-3}:2^{-4}:2^{-5}$.

In the case of a pixel in which the light emitting state is selected during all the subframe periods, it is assumed that an intensity of 100% can be represented. Here, in the case of a pixel in which the light emitting state is selected during only the first subframe period SF1, an intensity of about 51% can be represented. On the other hand, in the case of a pixel in which the light emitting state is selected during only the sixth subframe period SF6, an intensity of about 2% can be represented.

A block diagram showing the structure of the display device of the present invention using the above time gray scale method is the same as in FIG. 1. However, signals outputted from the signal control circuit, circuit structures of the respective signal line driver circuits, a driving method, and the like are different from the case in FIG. 1.

In this embodiment, as the first signal line driver circuit, there is used a circuit to which digital video signals of 6 bits are inputted and which outputs digital video signals corresponding to the inputted digital video signals of 6 bits to signal lines. In addition, as the second signal line driver circuit, there is used a circuit to which a digital video signal of the upper 1 bit is inputted and which outputs a digital video signal corresponding to the inputted digital video signal of the upper 1 bit to signal lines.

Fundamental structures and fundamental operations of the respective signal line driver circuits (first signal line driver circuit and second signal line driver circuit) and the signal control circuit of the display device according to this embodiment will be described below.

Figure 18:
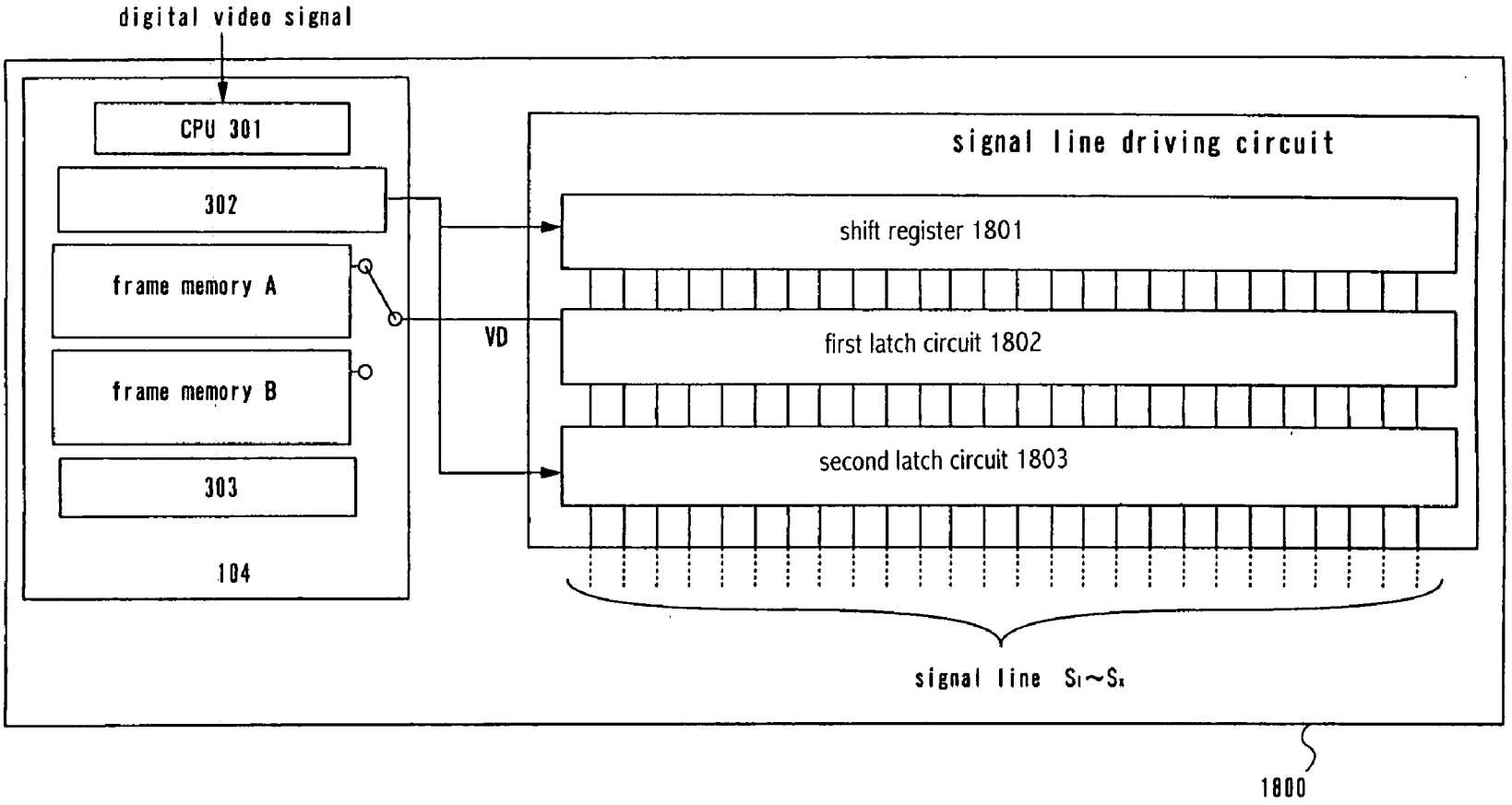
FIG. 18 is a block diagram of a signal line driver circuit and a signal control circuit in accordance with the present invention.

FIG. 18 is a block diagram showing the signal line driver circuit and the signal control circuit of the display device according to this embodiment.

First, the fundamental structures of the signal line driver circuit and the signal control circuit will be described.

In FIG. 18, the signal line driver circuit has a shift register 1801, a first latch circuit 1802, and a second latch circuit 1803.

Also, a signal control circuit 104 has a CPU 301, a display controller 302, a frame memory A, a frame memory B, and a memory controller 303.

Next, the fundamental operations of the signal line driver circuit and the signal control circuit will be described.

The digital video signals inputted to the display device are temporarily stored in the memory (frame memory A or frame memory B) in response to signals from the CPU 301 and the memory controller 303. The digital video signals stored in the memory are read therefrom for every bit in response to signals from the CPU 301 and the memory controller 303 and outputted to a wiring VD.

The digital video signals inputted to the signal line driver circuit are held in the first latch circuit 1802 in response to a sampling pulse from a shift register 1801. When the digital video signals corresponding to one pixel row are held in the first latch circuit 1802, a latch pulse is inputted to a second latch circuit 1803. Thus, the second latch circuit 1803 holds the digital video signals corresponding to one pixel row which are held in the first latch circuit 1802 at a time.

The digital video signals held in the second latch circuit 1803 are outputted as video signals to respective signal lines S1 to Sx.

Note that the output of the signal line driver circuit of this embodiment is not shown in FIG. 18. However, it is outputted to the signal lines S1 to Sx through the switching circuit 110 (110*a* or 110*b*).

Figure 10:
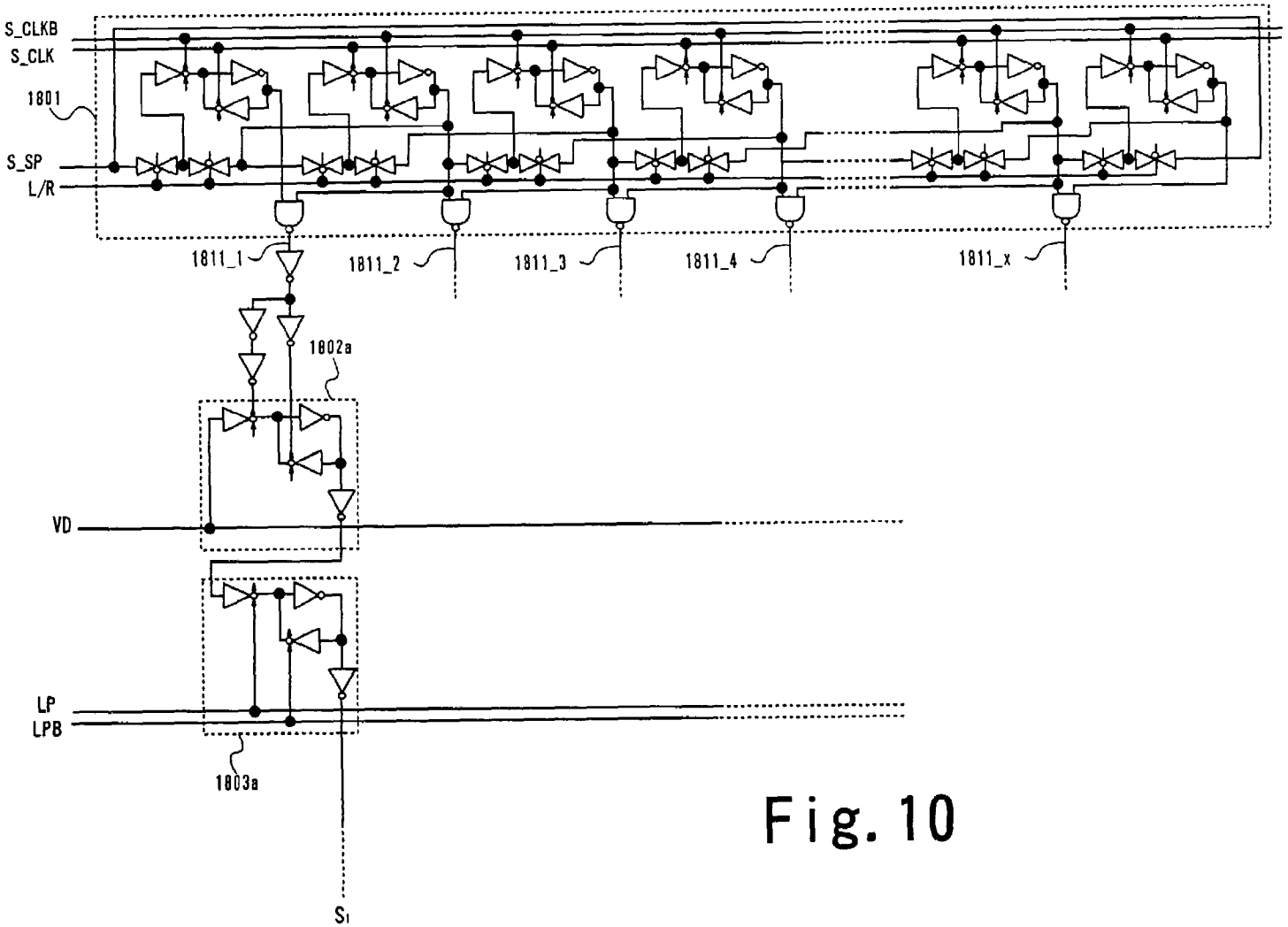
FIG. 10 is a circuit diagram showing the configuration of a signal line driver circuit.
Figure 11:
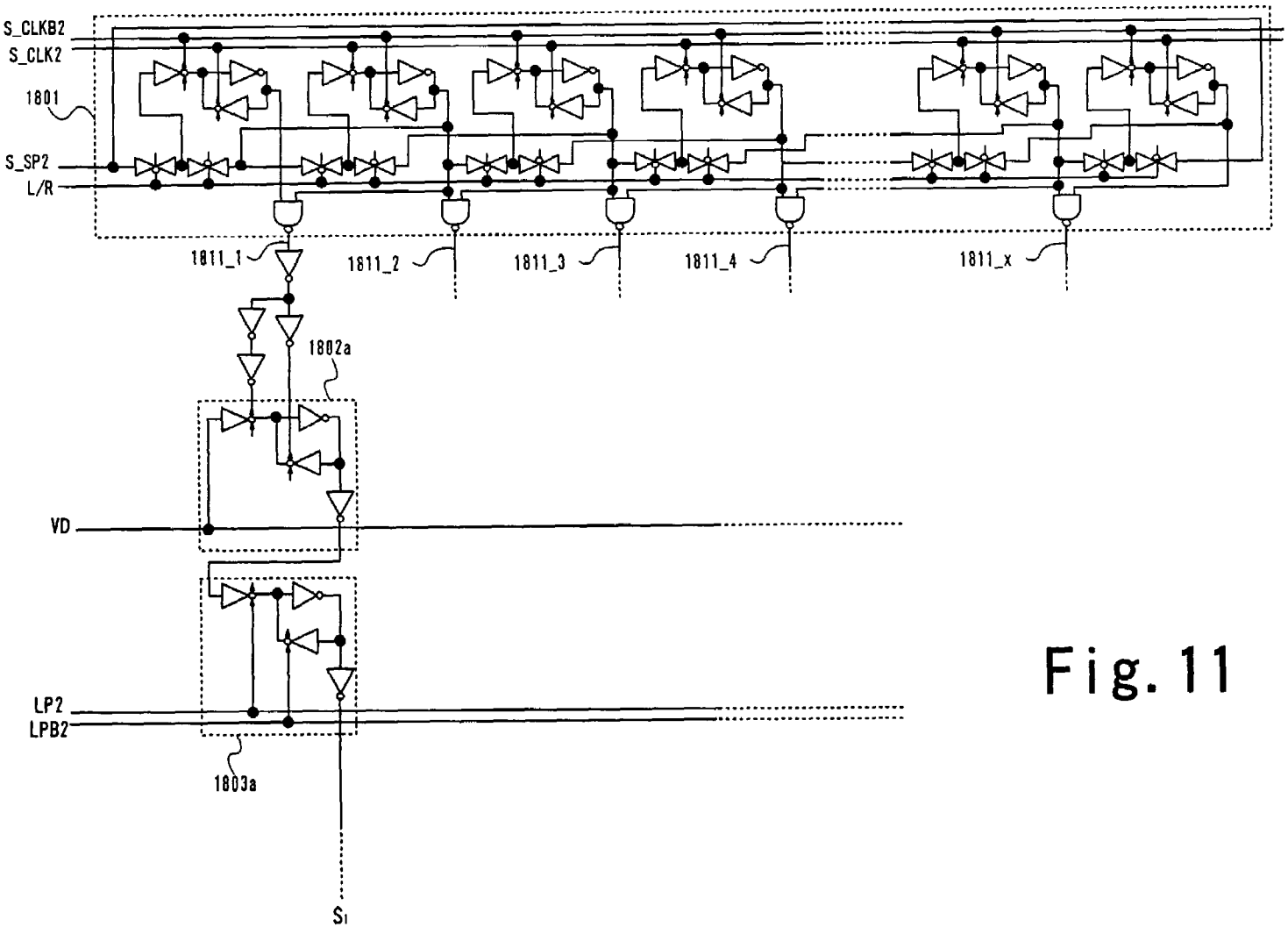
FIG. 11 is a circuit diagram showing the configuration of a signal line driver circuit.

FIG. 10 shows a circuit structure of the first signal line driver circuit of this embodiment and FIG. 11 shows a circuit structure of the second signal line driver circuit thereof. Note that the same portions as in FIG. 18 are indicated using the same reference numerals.

In FIG. 10, only a first signal line driver circuit 101 has the shift register 1801, the first latch circuit 1802, and the second latch circuit 1803.

In FIG. 10, a portion 1802*a* of the first latch circuit 1802 and a portion 1803*a* of the second latch circuit 1803 which correspond to the first signal line S1 are shown for a typical example.

In FIG. 11, only a second signal line driver circuit 102 has the shift register 1801, the first latch circuit 1802, and the second latch circuit 1803.

In FIG. 11, a portion 1802*a* of the first latch circuit 1802 and a portion 1803*a* of the second latch circuit 1803 which correspond to the first signal line S1 are shown for a typical example.

Note that the first signal line driver circuit shown in FIG. 10 and the second signal line driver circuit shown in FIG. 11 have the same structure. However, the frequencies of the clock signals S_CLK and S_CLK2 inputted to the respective signal line driver circuits are different from each other.

Further, in the first signal line driver circuit, the digital video signals of 6 bits are all inputted to a wiring VD shown in FIG. 10. On the other hand, in the second signal line driver circuit, the digital video signal of 1 bit is inputted to a wiring VD shown in FIG. 11.

Figure 12:
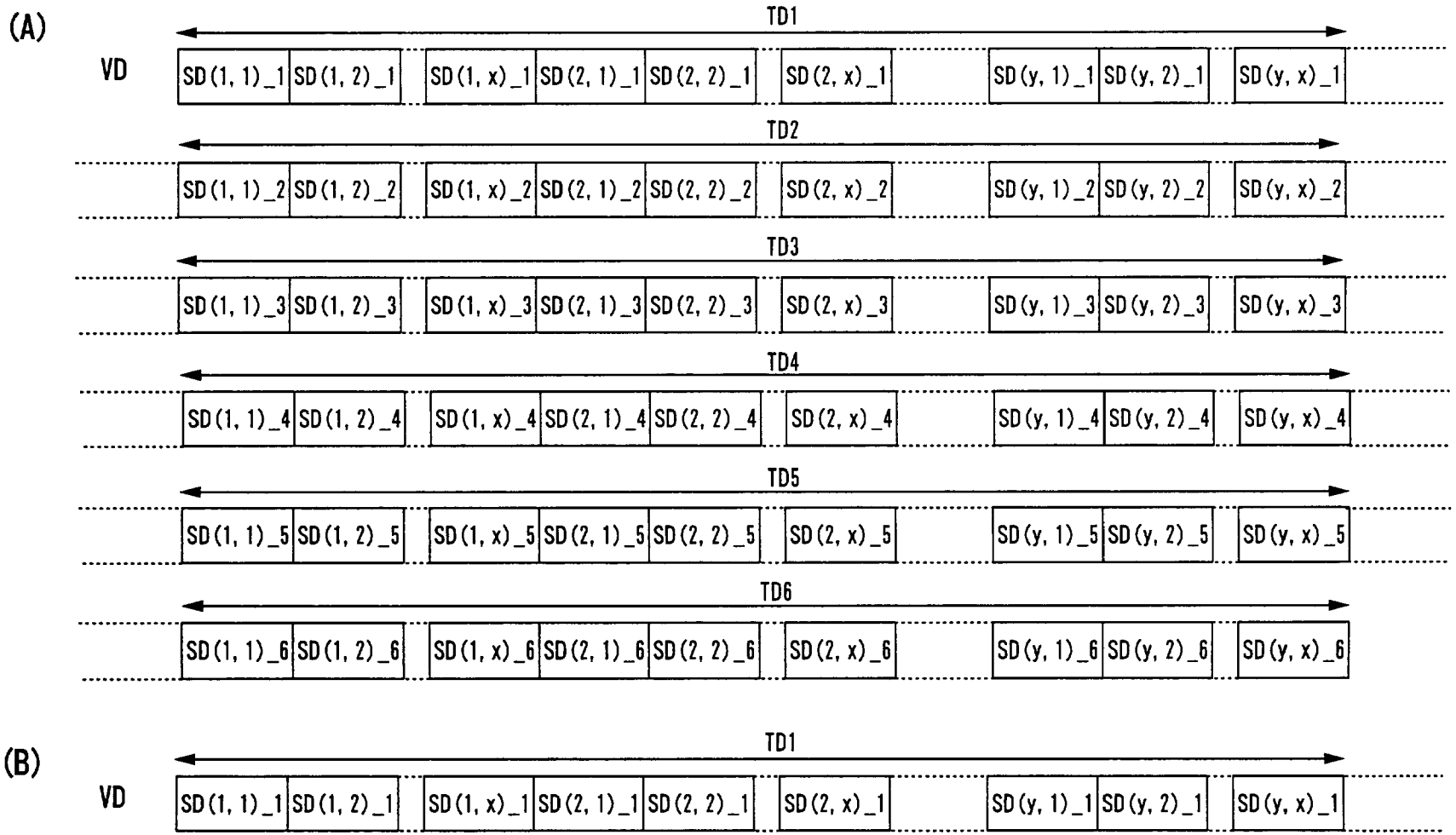
FIG. 12 is a diagram showing digital video signals in order of output.

FIG. 12A shows a list order in the digital video signals inputted to the wiring VD in the first signal line driver circuit shown in FIG. 10. In addition, FIG. 12B shows a list order in the digital video signals inputted to the wiring VD in the second signal line driver circuit. Note that SD (i, j)_g indicates a g-th bit signal for a pixel at i-th row and j-th column in FIGS. 12A and 12B.

Note that the display device has pixels of y-row and x-column.

As shown in FIG. 12A, with respect to signals inputted to the first signal line driver circuit of this embodiment through the wiring VD, signals SD (1, 1)_g to SD (y, x)_g of a frame which correspond to respective bits are inputted in order. A period for which g-th bit signals SD (1, 1)_g to SD (y, x)_g are inputted is referred to as TDg.

As shown in FIG. 12A, the digital video signals of the first to sixth bits are inputted to the first signal line driver circuit. When periods TD1 to TD6 are completed, the input of the digital video signals corresponding to a frame in the case where the 6-bit display is conducted is completed.

On the other hand, as shown in FIG. 12B, signals inputted to the second signal line driver circuit of this embodiment through the wiring VD are only signals SD (1, 1)_1 to SD (y, x)_1 of a frame which correspond to the first bits. Thus, when the period TD1 is completed, the input of the digital video signals corresponding to a frame in the case where the 1-bit display is conducted is completed.

A method of driving the first signal line driver circuit having the structure shown in FIG. 10 will be described below.

The clock pulse S_CLK and the inverted clock pulse S_CLKB obtained by inverting a polarity of the clock pulse are inputted to the shift register 1801. When the start pulse S_SP is inputted to the shift register 1801, it outputs a sampling pulse to wirings 1811_1 to 1811_x.

When the sampling pulse outputted from the shift register 1801 is inputted to the wiring 1811_1, the portion 1802*a* of the first latch circuit holds the digital video signal of the first bit SD (1, 1)_1 corresponding to a pixel at first row and first column which is inputted to the wiring VD.

The sampling pulse is inputted in order to the wirings 1811_1 to 1811 _x and the first latch circuit 1802 holds the digital video signals of the first bit SD (1, 1)_1 to SD (1, x)_1 corresponding to one pixel row.

After that, a latch pulse LP and an inverted latch pulse LPB obtained by inverting a polarity of the latch pulse LP are inputted to the second latch circuit 1803. Then, the second latch circuit 1803 holds the digital video signals SD (1, 1)_1 to SD (1, x)_1 which are held in the first latch circuit 1802 at a time.

The digital video signal of the first bit SD (1, 1)_1 which is held in the portion 1803*a* of the second latch circuit 1803 is outputted as a video signal to the signal line S1.

Such operation is conducted by the second latch circuit which corresponds to all the signal lines S1 to Sx. Thus, the video signals SD (1, 1)_1 to SD (1, x)_1 are outputted to all the signal lines S1 to Sx.

The second latch circuit 1803 holds the digital video signals of the first bit SD (1, 1)_1 to SD (1, x)_1 corresponding to a first pixel row. Simultaneously with this, the first latch circuit 1802 starts to hold digital video signals of the first bit SD (2, 1)_1 to SD (2, x)_1 corresponding to a second pixel row. Such operation is conducted for digital video signals corresponding to all the pixel rows, and the digital video signals of the first bit corresponding to all the pixels are outputted.

After that, similarly, digital video signals of the second bit which are inputted through the wiring VD are sampled and outputted as video signals. Thus, the digital video signals of 6 bits are sampled and outputted as video signals.

Accordingly, the output of the digital video signals corresponding to a frame is completed.

Note that the output of the first signal line driver circuit is not shown in FIG. 10. However, it is outputted to the signal lines S1 to Sx through the switching circuit 110*a*.

According to the display device having the first signal line driver circuit with the above structure, timing when a video signal is outputted to a pixel portion is changed in accordance with the latch pulse LP to represent a gray scale by a time gray scale method.

Next, a method of driving the second signal line driver circuit having the structure shown in FIG. 11 will be described below.

The clock pulse S_CLK2 and the inverted clock pulse S_CLKB2 obtained by inverting a polarity of the clock pulse are inputted to the shift register 1801. When the start pulse S_SP2 is inputted to the shift register 1801, it outputs a sampling pulse to wirings 1811_1 to 1811_x.

When the sampling pulse outputted from the shift register 1801 is inputted to the wiring 1811_1, the portion 1802*a* of the first latch circuit holds the digital video signal of the first bit SD (1, 1)_1 corresponding to a pixel at first row and first column which is inputted to the wiring VD.

The sampling pulse is inputted in order to the wirings 1811_1 to 1811 _x and the first latch circuit 1802 holds the digital video signals of the first bit SD (1, 1)_1 to SD (1, x)_1 corresponding to one pixel row.

After that, a latch pulse LP and an inverted latch pulse LPB obtained by inverting a polarity of the latch pulse LP are inputted to the second latch circuit 1803. Then, the second latch circuit 1803 holds the digital video signals SD (1, 1)_1 to SD (1, x)_1 which are held in the first latch circuit 1802 at a time.

The digital video signal of the first bit SD (1, 1)_1 which is held in a portion of the second latch circuit 1803 is outputted as a video signal to the signal line S1.

Such operation is conducted by the second latch circuit which corresponds to all the signal lines S1 to Sx. Thus, the video signals SD (1, 1)_1 to SD (1, x)_1 are outputted to all the signal lines S1 to Sx.

The second latch circuit 1803 holds the digital video signals of the first bit SD (1, 1)_1 to SD (1, x)_1 corresponding to the first pixel row. Simultaneously with this, the first latch circuit 1802 starts to hold the digital video signals of the first bit SD (2, 1)_1 to SD (2, x)_1 corresponding to the second pixel row. Such operation is conducted for digital video signals corresponding to all the pixel rows, and the digital video signals of the first bit corresponding to all the pixels are outputted.

Accordingly, the output of the digital video signals corresponding to a frame is completed.

Note that the output of the second signal line driver circuit is not shown in FIG. 11. However, it is outputted to the signal lines S1 to Sx through the switching circuit 110*b*.

In the case of the first signal line driver circuit shown in FIG. 10, the output of the video signal is required 6 times during a frame period. Thus, it is necessary to drive the first signal line driver circuit at a high frequency. On the other hand, in the case of the second signal line driver circuit shown in FIG. 11, a video signal is preferably outputted once during a frame period, so that it can be driven at a low frequency.

Thus, when the second signal line driver circuit is used in the case where the display in which the number of gray scale is reduced is conducted, the power consumption of the display device can be reduced.

Therefore, the first signal line driver circuit and the second signal line driver circuit each are constructed according to the number of gray scale to be represented. When the two signal line driver circuits are separately used, the redundant power consumption can be prevented in the display device.

Next, a structure of the signal control circuit 104 shown in FIG. 18 will be described.

The signal control circuit 104 can be constructed similar to the block diagram in FIG. 3. An operation method of the signal control circuit is substantially the same as the operation described in the embodiment mode, and therefore the description is omitted here.

Note that, in the display device of this embodiment, the digital video signals outputted from the signal control circuit 104 are read in the orders shown in FIGS. 12A and 12B.

When the 6-bit display is selected, the signals obtained by arranging the digital video signals of 6 bits for every bit according to all the pixels as shown in FIG. 12A are outputted to the wiring VD.

On the other hand, when the 1-bit display is selected, the memory R/W signal, the memory x-address, and the memory y-address are changed in response to the signal inputted from the CPU to the memory controller. Thus, the write of the digital video signal into the memory is conducted for only 1 bit. In addition, the read of the digital video signal from the memory is conducted for only 1 bit. Accordingly, as shown in FIG. 12B, the digital video signals of 1 bit is outputted to the wiring VD.

Thus, when the display in which the number of gray scales is reduced is conducted, it is possible that the number of operations of the storage and read of the digital video signal in and from the memory (frame memory A or frame memory B) is reduced, thereby decreasing the power consumption of the signal control circuit 104.

Also, when the time gray scale method is used as in this embodiment, the frequency of the clock signal S_CLK2 inputted to the second signal line driver circuit having the structure shown in FIG. 11 may be smaller than that of the clock signal S_CLK inputted to the first signal line driver circuit having the structure shown in FIG. 10. In addition, the frequency of the scanning line driver circuit in the case where the second signal line driver circuit is used may be smaller than that of the scanning line driver circuit in the case where the first signal line driver circuit is used.

Here, the drive frequency of the second signal line driver circuit 102 is set to be smaller than that of the first signal line driver circuit 101 by the display controller 302 shown in FIG. 3. Thus, when the display in which the number of gray scales is reduced is conducted, the power consumption of the display device can be reduced in the case where the second signal line driver circuit 102 is used.

Note that the example in which the first signal line driver circuit to which the digital video signals of 6 bits are inputted and which outputs the video signals and the second signal line driver circuit to which the digital video signal of 1 bit is inputted and which outputs the video signal are provided is indicated in this embodiment. However, the display device of the present invention is not limited to such a structure. Generally, the display device of the present invention can be constructed to have the first signal line driver circuit to which the digital video signals of n (where n is a natural number) bits are inputted and which outputs the video signals and the second signal line driver circuit to which the digital video signals of m (where m is a natural number smaller than n) bits are inputted and which outputs the video signals.

In addition to the first signal line driver circuit and the second signal line driver circuit which are described above, it may be constructed to have a third signal line driver circuit to which digital video signals of k (where k is a natural number smaller than n and different from m) bits are inputted and which outputs video signals. Thus, when an arbitrary number of signal line driver circuits are provided and a driving method selectively using them is employed, a reduction in power consumption of the display device can be realized.

Note that the digital video signal may be a voltage signal or a current signal.

Also, a decoder can be used as the scanning line driver circuit. Thus, pixel rows can be selected in an arbitrary order. Accordingly, a region displayed by the first signal line driver circuit and a region displayed by the second signal line driver circuit can be set in a frame.

Figure 13:
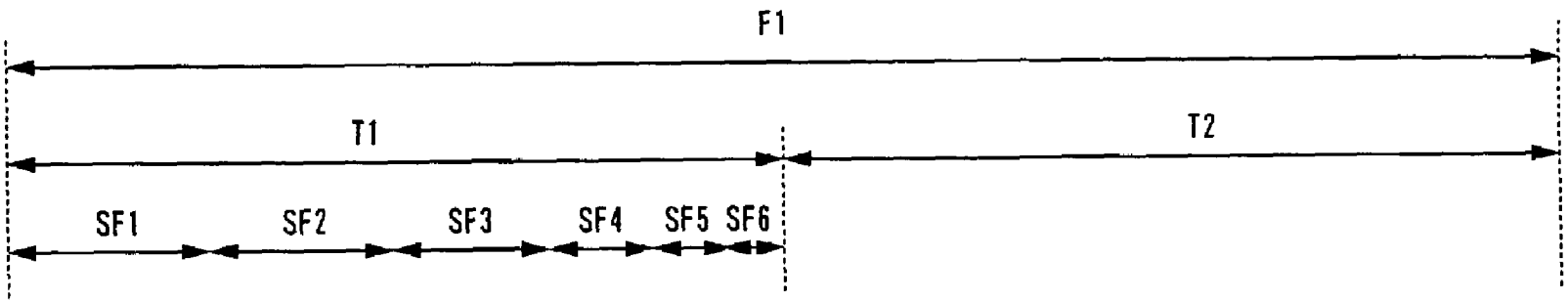
FIG. 13 is a diagram showing a driving method of a time gray scale method of the present invention.

For example, as shown in FIG. 13, the first signal line driver circuit is selected during a portion (T1) of a frame period F1, subframe periods SF1 to SF6 corresponding to 6 bits are provided, and 6-bit gray scale display is conducted. On the other hand, during a portion (T2) of the frame period, the second signal line driver circuit can be selected and 1-bit gray scale display can be conducted.

When the driving method shown in FIG. 13 is used, as shown in FIG. 4, it can be constructed that a video signal is inputted to a pixel in a region (E) of a display portion by using the second signal line driver circuit and a video signal is inputted to pixels in regions except the region (E) (regions (0)) by using the first signal line driver circuit.

Therefore, it is possible that the display in which the number of gray scales is reduced is conducted for the region (E) and the general multi gray scale display is conducted for the regions (0).

Also, according to the structure of the present invention, a video signal can be inputted to only a pixel in a portion of the pixel portion (display portion). Thus, an image can be displayed in the portion of the pixel portion.

By the above method, an area of a region of the display device on which an image is displayed can be arbitrarily changed.

Embodiment 2

In this embodiment, an example of the pixel configuration of the display device of the present invention is described.

Figure 14:
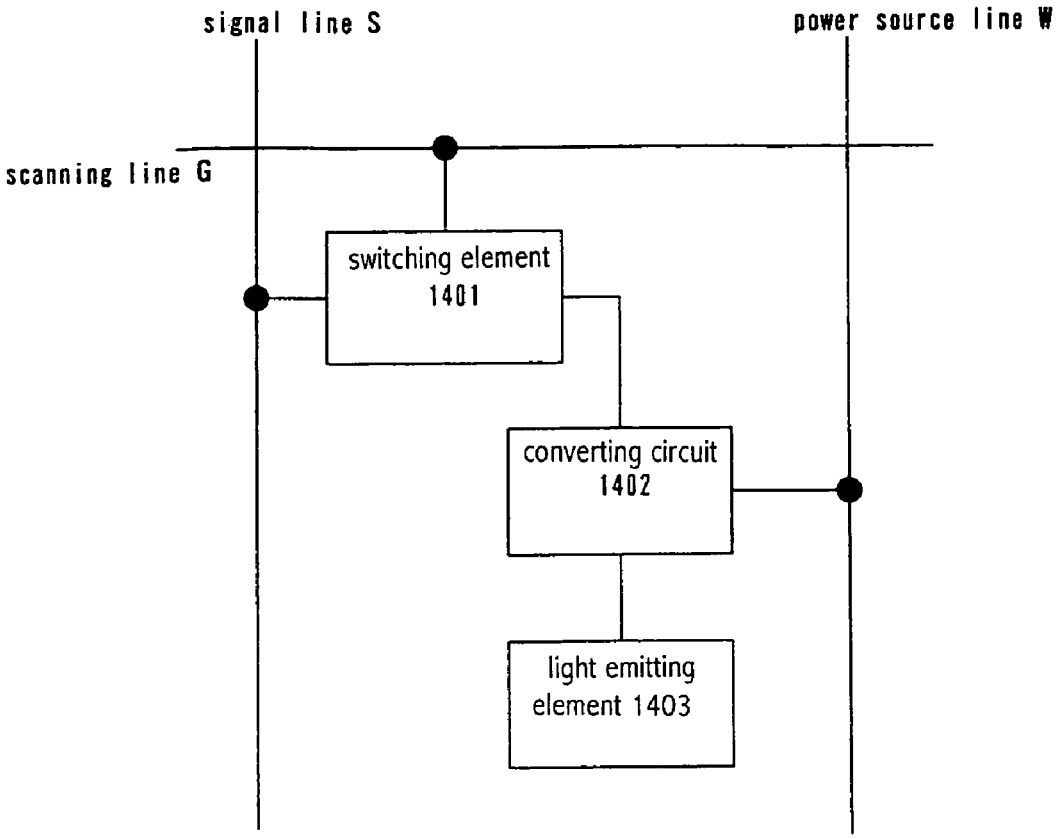
FIG. 14 is a block diagram showing the configuration of pixels in a display device of the present invention.

An example of the configuration of a pixel is shown in FIG. 14. As shown in FIG. 14, the pixel is comprised of a signal line S, a scanning line W, a power source line W, a switching element 1401, a converting circuit 1402, and a light emitting element 1403.

Note that the video signal can be used either an analog signal or digital signal. Also, a voltage signal or a current signal can be used.

The video signal, which is inputted to the signal line S, is inputted to the pixel in which the scanning line G is selected, and a switching element 1401 is ON state. The video signal inputted to the pixel is converted to the correspondent current signal or voltage signal in the convert circuit 1402 in which power is supplied from the power source line W.

In the pixel in which the video signal is inputted, the light emitting element 1403 is emitted by that a predetermined voltage is applied to and a predetermined current is flowed through the light emitting element 1403.

The converting circuit 1402 is possible to have a function of maintaining an inputted video signal.

The first specific example of the pixel configuration shown in FIG. 14 is described with reference to FIG. 15.

Figure 15:
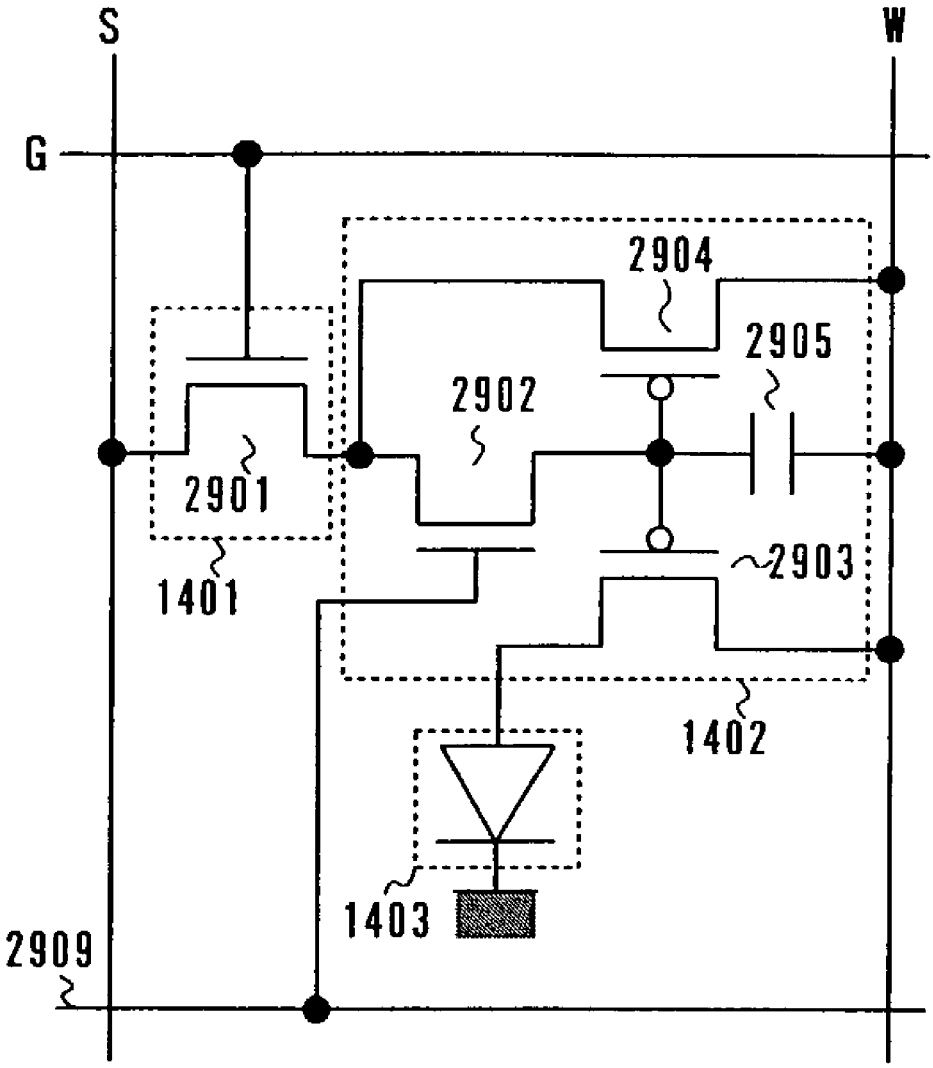
FIG. 15 is a circuit diagram showing the configuration of pixels in a display device of the present invention.

FIG. 15 is shown that each pixel is comprised of the signal line S, the scanning line G, the power source line W, the switching element 1401, the converting circuit 1402, and the light emitting element 1403.

The switching element 1401 is structured by a switching transistor 2901. The converting circuit 1402 is comprised of a current transistor 2904, a current source transistor 2903, a current retention transistor 2902, and a retention capacitor 2905.

In addition, the light emitting element 1403 is described typically as an OLED.

Note that the OLED is used as the light emitting element in this embodiment, however the light emitting element is not necessary to limit to the OLED in the present invention. Well known EL elements such as EL elements made of inorganic materials, and EL elements that are combinations with inorganic materials and organic materials can also be used for the light emitting element.

A gate electrode of the switching transistor 2901 is connected to the scanning line G. Either of a source terminal or a drain terminal of the switching transistor 2901 is connected to the signal line S, and the other is connected to the a drain terminal of the current transistor 2904, or either of a source terminal or a drain terminal of the current transistor 2902.

A source terminal of the current transistor 2904 is connected to the power source line W. A source terminal of the current retention transistor 2902 or a drain terminal that is not connected to the switching transistor 2901 is connected to a gate electrode of the current transistor 2904, a gate electrode of the power source transistor 2903, either electrode of the retention capacitor 2905. The electrode of the retention capacitor 2905 that is not connected to the current retention transistor is connected to the power source line W. A source terminal of the power source transistor 2903 is connected to the power source line W, the drain terminal thereof is connected to the either of the light emitting element 1403.

The gate electrode of the current retention transistor 2902 is connected to the wiring 2909.

In FIG. 15, a configuration that the current transistor 2904 and the power source transistor 2903 assumed as a p-channel type transistor is described. However, the configuration can be found the application to the configuration that the current transistor 2904 and the power source transistor 2903 assumed as an n-channel type transistor. In this regard, the polarities of the current transistor 2904 and the power source transistor 2903 must be same polarities.

Since the switching transistor 2901 and the power retention transistor 2902 function merely as switches, either n-channel type or p-channel type of transistor can be used.

The operation of the pixel shown in FIG. 15 is described.

The video signal inputted to the signal line S can be identified as a current signal so that video signal is also referred to as the signal current hereinafter.

When the switching transistor 2901 is turned ON by the signal inputted by the scanning line G, the signal current that is inputted to the signal line S is inputted to the converting circuit 1402. At this point, the current retention transistor 2902 is turned ON by the signal inputted to the wiring 2909.

The signal current inputted to the converting circuit 1402 flows through the source and drain terminals of the current transistor 2904. The gate and drain terminals of the current transistor 2904 are connected each other via the ON state current retention transistor 2902. Therefore, the current transistor 2904 operates in the saturation region.

In this way, the signal current flows continuously through source and drain terminals of the current transistor 2904 as the current retention transistor 2902 is kept ON state. As time go on, the gate voltage of the current transistor 2904 is adjusted to the predetermined voltage so as to be as same as the value of the signal current, thereby the gate voltage is retained in the retention capacitor 2905. After that, the current retention transistor 2902 is turned OFF state by the signal inputted to the wiring 2909.

When the characteristic of the current transistor 2904 is the same as that of the current source transistor 2903, the drain current of the current transistor 2904 is the same as that of the current source transistor 2903.

The electric current from the power source line W that is equal to the inputted signal current via the current source transistor 2903 is inputted to the light emitting element 1403. Thus, the light emitting element 1403 is emitted by the luminance according to the video signal (signal current).

Even when the signal current is not inputted to the pixel, the current source transistor 2903 continues to flow the current equal to the signal current by the voltage retained in the retention capacitor 2905.

The second specific example of pixel configuration shown in FIG. 14 is described with reference to FIG. 16.

Figure 16:
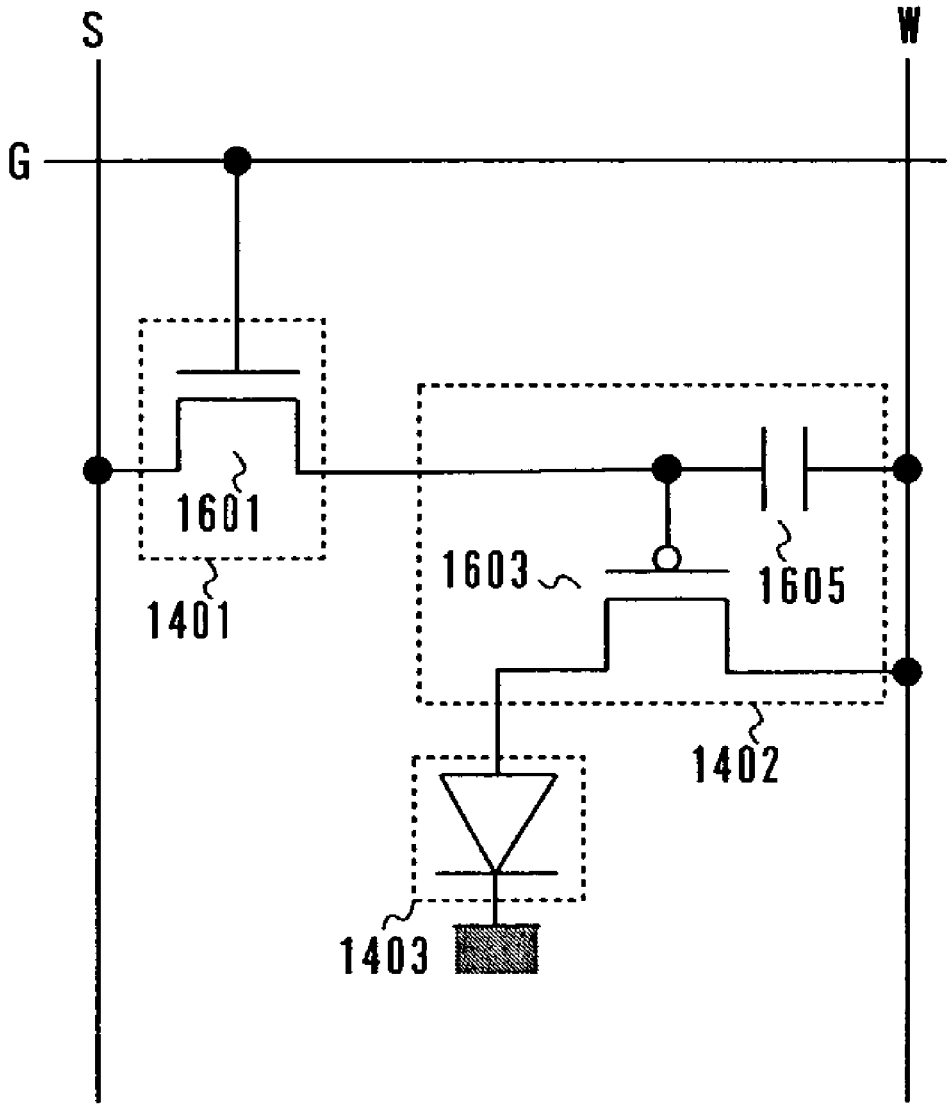
FIG. 16 is a circuit diagram showing the configuration of pixels in a display device in accordance with the present invention.

FIG. 16 is shown that each pixel is comprised of the signal line S, the scanning line G, the power source line W, the switching element 1401, the converting circuit 1402, and the light emitting element 1403.

The switching element 1401 is structured by a switching transistor 1601. The converting circuit 1402 is comprised of a driver transistor 1603 and a retention capacitor 2905.

In addition, the light emitting element 1403 is described typically as an OLED.

Further, the OLED is used as the light emitting element in this embodiment, however the light emitting element is not necessary to limit to the OLED in the present invention. Well known EL elements such as EL elements made of inorganic materials, and EL elements that are combinations with inorganic materials and organic materials can also be used for the light emitting element.

A gate electrode of the switching transistor 1601 is connected to the scanning line G. Either of a source terminal or a drain terminal of the switching transistor 1601 is connected to the signal line S, and the other is connected to the gate electrode of the driver transistor 1603, or the either electrode of the retention capacitor 1605. Other electrode of the retention capacitor 1605 is connected the power source line W. Either of the source terminal or a drain terminal of the driver transistor 1603 is connected to the power source line W, the other is connected to the either electrode of the light emitting element 1403.

The operation of the pixel shown in FIG. 16 is described.

The video signal inputted to the signal line S can be identified as a voltage signal so that video signal is also referred to as the current voltage hereinafter.

When the switching transistor 1601 is turned ON by the signal inputted to the scanning line G, the signal voltage that is inputted to the signal line S is inputted to the converting circuit 1402. The signal voltage that is inputted to the converting circuit 1402 is inputted to the gate electrode of the driver transistor 1603. The signal voltage that is inputted to the converting circuit 1402 is retained in the retention capacitor 1605.

The signal voltage inputted by the driver transistor 1603 is converted into the drain current. Therefore, electric current from the power source line W flows through the light emitting element 1403 via the driver transistor 1603, thereby the light emitting element 1403 is emitted by the luminance according to the video signal (signal voltage).

Note that the pixel configuration of the display device of the present invention is not limited to the above-mentioned configuration, all-known configuration are possible to be used.

This embodiment can be implemented by combining freely with Embodiment 1.

Embodiment 3

As light emitting element that is arranged in each pixel of the display device of the present invention, an EL element that is represented by OLED, elements that use an electron source element, an element that emit light in each pixel when the electrical current flows can be freely used.

In this embodiment, the light emitting element that is arranged in each pixel of the display device of the present invention is formed by using MIM type electron source element. And an example of forming the display device is described.

MIM type electron source element draws an attention as an element that can be miniaturized, formed having uniform characteristics, and driven with low-voltage.

Figure 17:
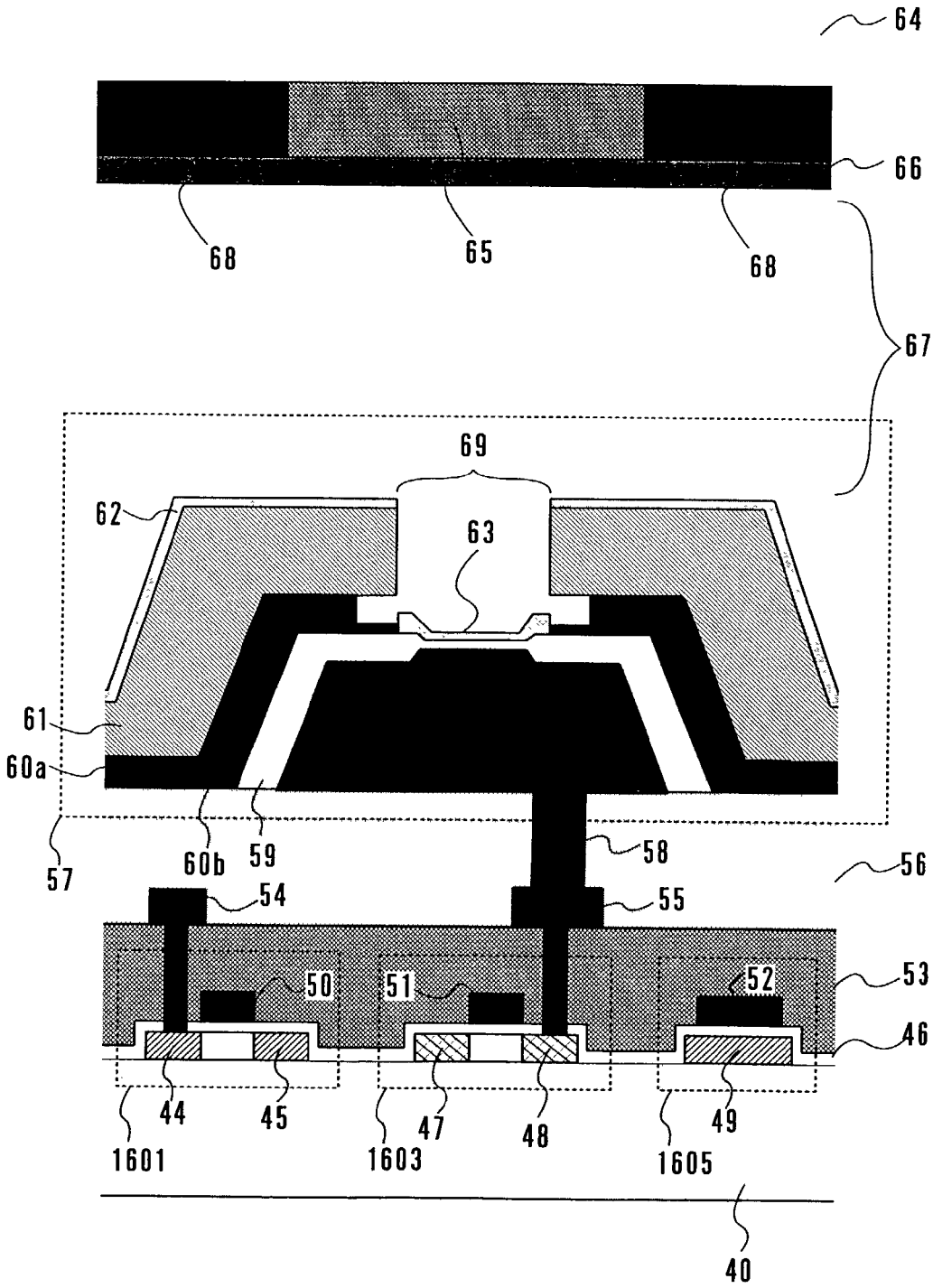
FIG. 17 is a cross-section view of pixels in a display device of the present invention.

FIG. 17 shows a cross-sectional view illustrating the pixel configuration of the display device of the present invention.

As the pixel configuration, same configuration shown in FIG. 16 of Embodiment 2 is used. FIG. 17 shows the switching transistor 1601 functioning as a switching element, the driver transistor 1603, a retention capacitor 1605, and a light emitting element.

A manufacturing example of the switching transistor 1601 and the driver transistor 1603 by using TFT (Thin Film Transistor) is described.

In FIG. 17, the switching transistor 1601, the driver transistor 1603, the retention capacitor 1605, the electron source element 57 are formed in sequence on the substrate 40 having an insulating surface. The electron source element 57 is comprised of a bottom electrode 58, a top electrode 63, and an insulating film 59 sandwiched between the bottom electrode 58 and the top electrode 63 on an insulating film 56 made of insulator. The reference numeral 46 is a gate insulating film, 53 is a interlayer insulating film, 61 is a protective insulating layer, 60*a* is a contact electrode, 60*b* is a top electrode bus line, and 62 is a protective electrode.

A gate electrode 50 of the switching transistor 1601 is connected to the scanning line (not illustrated). The impurity region 44 of the switching transistor 1601 is connected to the signal line 54, and the impurity region 45 is connected to the gate electrode 51 of the driver transistor 1603, or either electrode 52 of the retention capacitor 1605. Either electrode 49 of the retention capacitor 1605 is connected to the power source line W (not illustrated). The impurity region 47 of the driver transistor 1603 is connected to the power source line W (not illustrated). The impurity region 48 of the driver transistor 1603 is connected to the electrode 55. The electrode 55 is connected to the bottom electrode 58 of the electron source element 57. A constant electric potential is applied to the top electrode 63 of the electron source element 57 via the contact electrode 60*a* and the top electrode bus line 60*b* in all pixels.

Here, the impurity region corresponds to the source or drain region of TFT. In the case that the impurity region 44 is a source region, the impurity region 45 corresponds to the drain region. In the case that the impurity region 44 is a drain region, the impurity region 45 corresponds to the source region. Similarly, in the case that the impurity region 47 is a source region, the impurity region 48 corresponds to the drain region, in the case that the impurity region 47 is a drain region, the impurity region 48 corresponds to the source region.

FIG. 17 described that the pixel electrode is a bottom electrode 58, however the pixel electrode can be a top electrode. At this time, a constant electric potential is applied to the bottom electrode in all pixels.

The substrate 64 is provided so as to face with the substrate 40 on which said electron source element 57 is provided. In addition, the substrate 64 is a transparent to the light. On the substrate 64, the fluorescent material 65 is provided so as to face up to the electron discharge region 69 of said electron source element 57. In the periphery of the fluorescent material 65, a black matrix 68 is provided. Further, a metal back layer 66 is formed on the surface of the fluorescent material 65. The empty space 67 between the substrate 40 and the substrate 64 is vacuated.

As the manufacturing method of the switching transistor 1601, the driver transistor 1603, and the retention capacitor 1605, a known method can be freely used. When these TFTs are formed, the insulating film 56 made of insulator and the electron source element are formed thereon in sequence. At this time, it is necessary that the irregularities of the switching transistor 1601, the driver transistor 1603, the retention capacitor 1605, and the wiring 55 are smoothed sufficiently and that materials and thickness are selected in order to obtain flat surface.

The electron source element 57 is formed on the smoothed insulating surface. Forming a contact hole connected to the wiring 55 of the driver transistor 1603 on the smoothed interlayer film 56 before forming the electron source element, the bottom electrode and the driver transistor 1603 can be connected to the wiring 55 simultaneously with the formation of the bottom electrode. As the manufacturing method of the electron source element 57, known method can be used.

Here, the bottom electrode 58 of the electron source element 57 can be used as a light-shielding film of the pixel TFT (the switching transistor 1601, the driver transistor 1603).

It is not always necessary that the electron source element is arranged to overlap with the TFT (the switching transistor 1601, the driver transistor 1603) comprising a pixel.

By application of the voltage between the top electrode 63 and the bottom electrode 58, the hot carrier is injected to the insulating film 59. Among the injected hot carrier, the one that has bigger energy than the work function of materials for the top electrode 63 is discharged into vacuum passing through the top electrode 63.

In the display device having the pixel shown in this embodiment, the electron source element is arranged to overlap with TFT of each pixel, so that the microscopic pixel can be formed.

In this embodiment, the display device (FED) that displays by using a MIM type electron source element shown in FIG. 17 is described as an example. The present invention can be applied to the MIM electron source element having other configuration, the electron source element having a configuration except the MIM type, and the electron source element having all-known configurations.

This embodiment can be implemented by freely combining with Embodiments 1 or 2.

Embodiment 4

In Embodiment 4, in case that the light emitting element is an OLED in each pixel, a method of sealing the OLED display device is described referred to as FIG. 19. And the example shown here is in case that transistors consisted of a pixel portion and a drive circuit provided in the periphery of the pixel portion are TFTs.

In Embodiment 4, an OLED is used as a light emitting element, but the present invention is not solely limited to the OLED, EL elements using inorganic material, EL elements using inorganic material combined with organic material, and a known EL element also can be used as a light emitting element.

FIG. 16 shows an example of configuration of individual pixel.

Figure 19A:
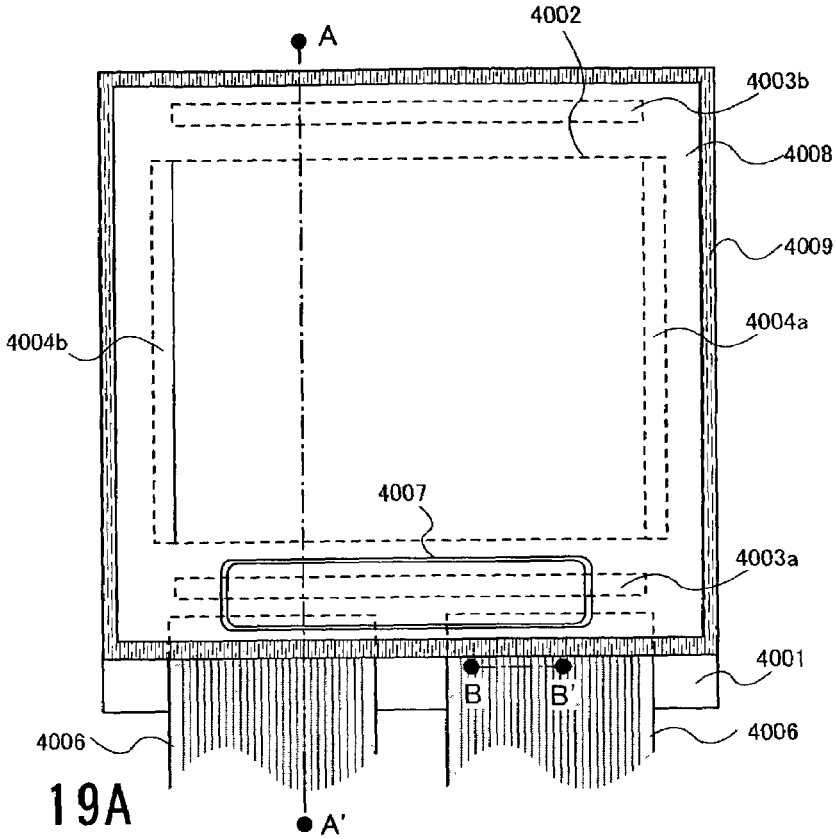
FIGS. 19A to 19C are group views including a top view and a cross-section view showing the configuration of a display device of the present invention.
Figure 19B:
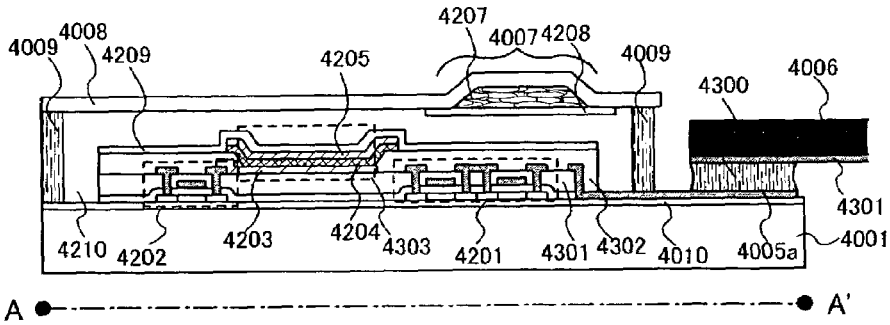
Figure 19C:
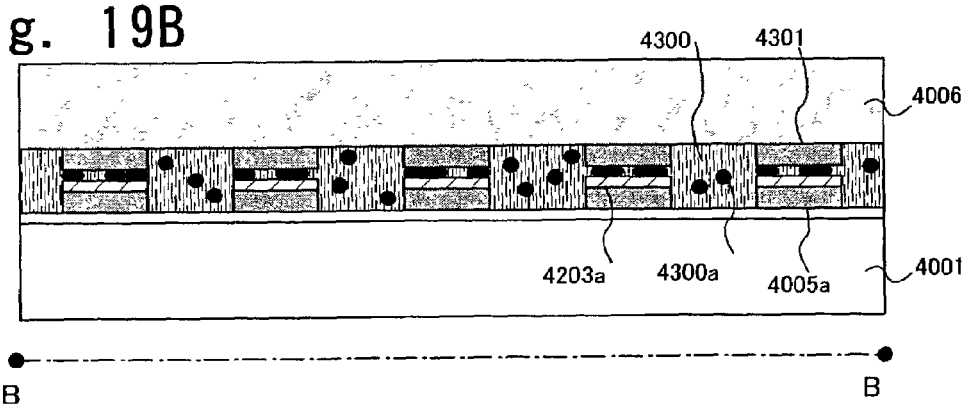

FIG. 19A is a top view of a display device, FIG. 19B is a cross-sectional view taken along a line A–A' of FIG. 19A, and FIG. 19C is a cross-sectional view taken along a line B–B' of FIG. 19A.

A seal member 4009 is provided so as to surround a combination of a pixel portion 4002, a signal line driver circuit 4003 (a first and a second signal line driver circuits 4003*a* and 4003*b*), a scanning line driver circuit 4004 (a first and a second scanning line driver circuits 4004*a* and 4004*b*) which are provided on a substrate 4001. Further, a sealing member 4008 is provided over the combination of a pixel portion 4002, a signal line driver circuit 4003, and a scanning line driver circuit 4004. Thus, the combination of a pixel portion 4002, a signal line driver circuit 4003, and a scanning line driver circuit 4004 are sealed by the substrate 4001, the seal member 4009, and the sealing member 4008 with a filler 4210.

Further a pixel portion 4002, a first and a second signal line driver circuits 4003*a* and 4004*b*, a first and a second scanning line driver circuits 4004*a* and 4004*b* provided on the substrate 4001 include a plurality of TFTs. FIG. 19B typically shows a driver circuit TFT (n-channel type TFT and p-channel type TFT are shown in this embodiment) 4201 included in a first signal line driver circuit 4003*a* and a driving TFT 4202 included in a pixel portion 4002, which are formed on an under film 4010.

In this embodiment, the p-channel type TFT and the n-channel type TFT manufactured by a well-known method are used as the driver circuit TFT 4201, and a p-channel TFT manufactured by a well-known method is used as the driving TFT 4202. Further, a storage capacitor (not shown in the figure) connected to the gate of the driving TFT 4202 is provided at the pixel portion 4002.

A first interlayer insulating film (flattening film) 4301 is formed on the driver circuit TFT 4201 and the driving TFT 4202. Then, a pixel electrode (anode) 4203 electrically connected to a drain of the driving TFT 4202 is formed thereon. A transparent conductive film having a high work function is used as the pixel electrode 4203. A compound of indium oxide and tin oxide, a compound of indium oxide and zinc oxide, zinc oxide, tin oxide, or indium oxide can be used for the transparent conductive film. Further, the transparent conductive film added with gallium may be used.

An insulating film 4302 is formed on the pixel electrode 4203. An opening portion is formed in the insulating film 4302 over the pixel electrode 4203. In this opening portion, an organic compound layer 4204 is formed on the pixel electrode 4203. A well-known organic material or inorganic material can be used for the organic compound layer 4204. Although the organic material includes a low molecular system (monomer system) and a high molecular system (polymer system), either may be used.

As a formation method of the organic compound layer 4204, a well-known evaporation technique or coating technique may be used. The structure of the organic compound layer may be a laminate structure obtained by freely combining a hole injection layer, a hole transporting layer, a light emitting layer, an electron transporting layer, or an electron injection layer, or a single layer structure.

A cathode 4205 made of a conductive film (typically, a conductive film containing aluminum, copper or silver as its main ingredient, or a laminate film of those and another conductive films) having a light shielding property is formed on the organic compound layer 4204. It is desirable that moisture and oxygen existing on the interface between the cathode 4205 and the organic compound layer 4204 are removed to the utmost. Accordingly, it is necessary to make such contrivance that the organic compound layer 4204 is formed in a nitrogen or rare gas atmosphere, and the cathode 4205 is formed while the organic compound layer is not exposed to oxygen or moisture. In this embodiment, a multi-chamber system (cluster tool system) film forming apparatus is used, so that the film formation as described above is enabled. A predetermined voltage is applied to the cathode 4205.

In the manner as described above, a light-emitting element 4303 constituted by the pixel electrode (anode) 4203, the organic compound layer 4204, and the cathode 4205 are formed. Then, a protection film 4209 is formed on the insulating film 4302 so as to cover the light-emitting element 4303. The protection film 4209 is effective to prevent oxygen, moisture and the like from penetrating into the light-emitting element 4303.

Reference numeral 4005*a* designates a drawing wiring line connected to a power supply line and is electrically connected to a source region of the driving TFT 4202. The drawing wiring line 4005*a* passes between the seal member 4009 and the substrate 4001, and is electrically connected to an FPC wiring line 4301 included in an FPC 4006 through an anisotropic conductive film 4300.

As the sealing member 4008, a glass member, a metal member (typically, a stainless member), a ceramic member, or a plastic member (including a plastic film) can be used. As the plastic member, an FRP (Fiberglass-Reinforced Plastics) plate, a PVF (polyvinyl fluoride) film, a Mylar film, a polyester film or an acryl resin film can be used. Further, a sheet having such a structure that an aluminum foil is interposed between PVF films or Mylar films can also be used.

However, in the case when the radiation direction of light from the light-emitting element is directed toward the side of a cover member, the cover member must be transparent. In this case, a transparent material such as a glass plate, a plastic plate, a polyester film, or an acryl film is used.

As the filler 4210, in addition to an inert gas such as nitrogen or argon, ultraviolet ray curing resin or thermosetting resin can be used, and PVC (polyvinyl chloride), acryl, polyimide, epoxy resin, silicone resin, PVB (polyvinyl butyral), or EVA (ethylene-vinyl acetate) can be used. In this embodiment, nitrogen was used as the filler.

Further, in order to expose the filler 4210 to a hygroscopic material (preferably, barium oxide) or a material capable of adsorbing oxygen, a recess portion 4007 is provided on the surface of the sealing member 4008 on the side of the substrate 4001 and the hygroscopic material or the material 4207 capable of adsorbing oxygen is disposed. Then, in order to prevent the hygroscopic material or the material 4207 capable of adsorbing oxygen from scattering, the hygroscopic material or the material capable of adsorbing oxygen are held in the recess portion 4007 by a recess cover member 4208. Note that, the recess cover member 4208 is formed into a fine mesh, and has such a structure that air or moisture is permeated and the hygroscopic material or the material 4207 capable of adsorbing oxygen is not permeated. The deterioration of the light-emitting element 4303 can be suppressed by providing therewith the hygroscopic material or the material 4207 capable of adsorbing oxygen.

As shown in FIG. 19C, at the same time as the formation of the pixel electrode 4203, a conductive film 4203*a* is formed to be in contact with the drawing wiring line 4005*a*.

The anisotropic conductive film 4300 includes a conductive filler 4300*a*. The substrate 4001 and the FPC 4006 are thermally compressed, so that the conductive film 4203*a* on the substrate 4001 and the FPC wiring line 4301 on the FPC 4006 are electrically connected through the conductive filler 4300*a*.

Further, this embodiment can be implemented by freely combined with

Embodiments 1 to 3.

Embodiment 5

In Embodiment 5, a technique of colorization of a display device of the present invention will be described.

In the display device shown in Embodiment 5, a plurality of pixels which comprise a pixel portion are divided into a plurality of regions. And each region thereof is displayed in the same color.

As described above, in the pixel portion, a structure that the pixels displaying same color are arranged together is referred to as an area color mode.

That is, in the display device shown in the present invention, a plurality of pixels which comprise a pixel portion are arranged together according to the same display color.

Figure 20:
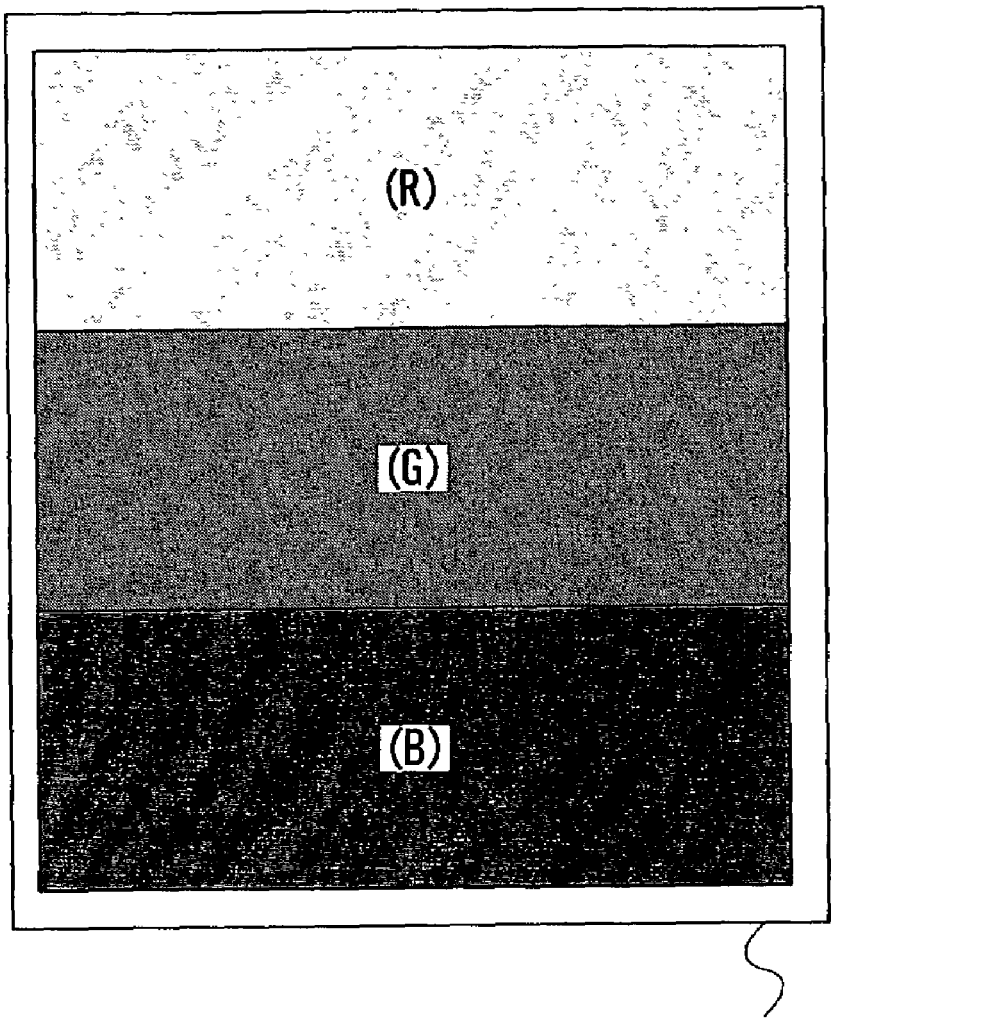
FIG. 20 is a view showing a frame format of the configuration of a pixel portion in a display device of the present invention.

FIG. 20 is a view showing a frame format of the configuration of a pixel portion in a display device of the present invention. In FIG. 20, a display portion (pixel portion) is divided into an R portion displaying red color, a G portion displaying green color, and a B portion displaying blue color. Each portion ((R), (G), (B)) is comprised by a plurality of pixels arranged in matrix, respectively.

Note that, the display colors are not limited to the colors mentioned above, arbitrary display color portion can be formed and displayed by area color mode.

In a display device having the pixel portion shown in FIG. 20, an arbitrary gray scale of each part can be displayed by the technique shown in Embodiment Modes and Embodiment 1, etc.

For example, in the R region displaying red color, an n (where n is a natural number) bit video signal can be used to represent a gray scale, in the G region and B region, m (where m is a natural number smaller than n) bits video signal can be used to represent gray scales.

Further, in the same display color portion, it is practicable that partially using an n bit video signal to represent the gray scale, and, additionally using an m bit video signal to represent the gray scale.

Embodiment 5 can be performed by freely combined with Embodiments 1 to 4.

Embodiment 6

In Embodiment 6, Examples of electronic apparatuses of the present invention will be described with FIG. 21.

The following can be given as examples of such apparatuses of the present invention: a portable information terminal; a personal computer; an image reproduction device; a television; a head mount display; a video camera and the like.

Figure 21A:
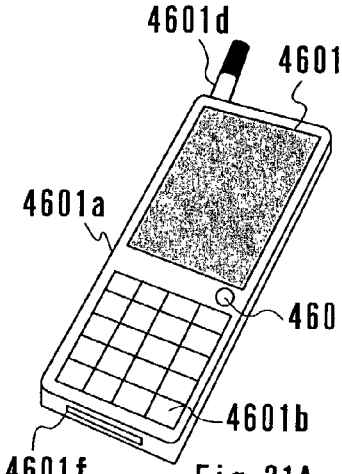
FIGS. 21A to 21F are group views showing apparatuses of the present invention.

FIG. 21A illustrates a diagram of the portable information terminal of the present invention which includes a main body 4601*a*, an operation switch 4601*b*, a power supply switch 4601*c*, an antenna 4601*d*, a display portion 4601*e* and an external input port 4601*f*. A display device described in Embodiment Modes and Embodiments 1 to 5 is used in the display portion 4601*e*.

Figure 21B:
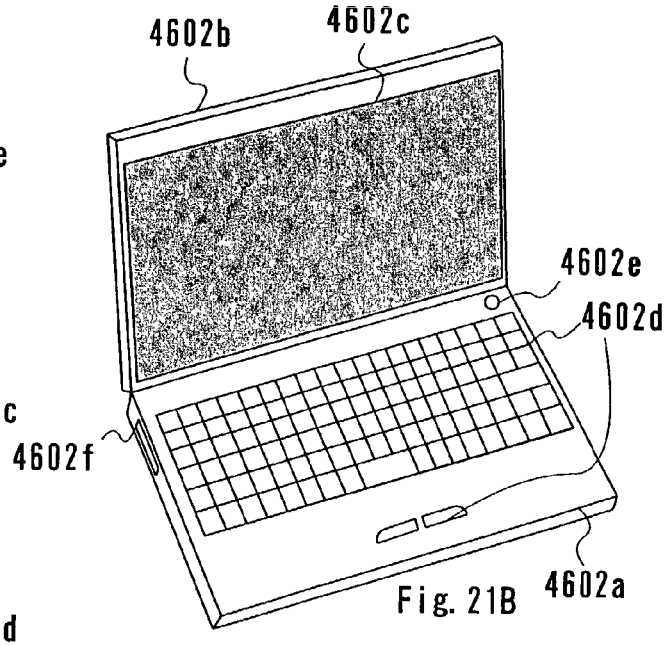

FIG. 21B illustrates a diagram of the personal computer of the present invention which includes a main body 4602*a*, a casing 4602*b*, a display portion 4602*c*, an operation switch 4602*d*, a power supply switch 4602*e* and an external input port 4602*f*. A display device described in Embodiment Modes and Embodiments 1 to 5 is used in the display portion 4602*c*.

Figure 21C:
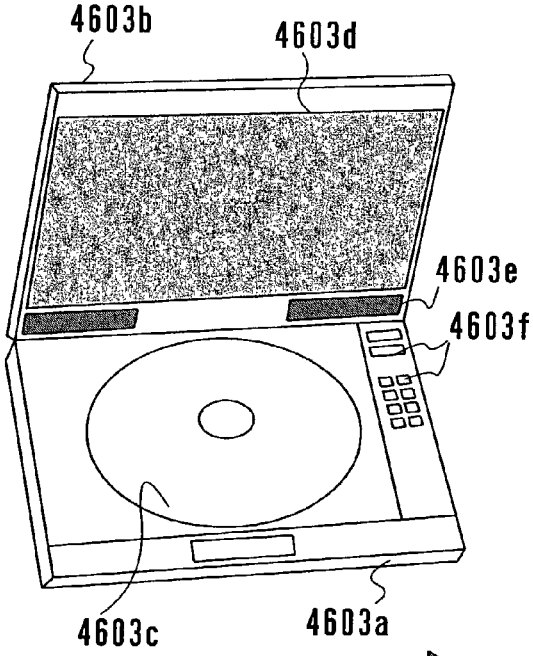

FIG. 21C illustrates a diagram of the image reproduction device of the present invention which includes a main body 4603*a*, a casing 4603*b*, a record medium 4603*c*, a display portion 4603*d*, an sound output portion 4603*e*, an operation switch 4603*f*. A display device described in Embodiment Modes and Embodiments 1 to 5 is used in the display portion 4604*c*.

Figure 21D:
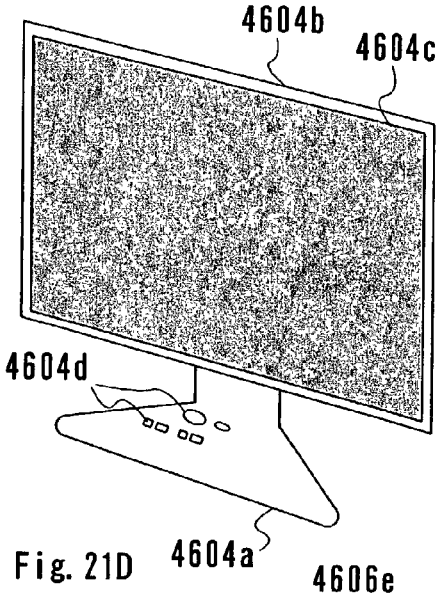

FIG. 21D illustrates a diagram of the television of the present invention which includes a main body 4604*a*, a casing 4604*b*, a display portion 4604*c* and an operation switch 4604*d*. A display device described in Embodiment Modes and Embodiments 1 to 5 is used in the display portion 4604*c*.

Figure 21E:
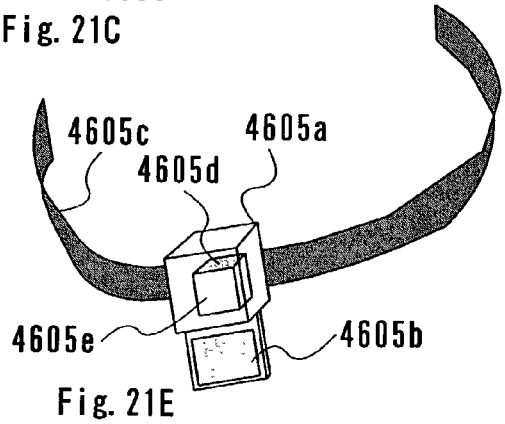

FIG. 21E illustrates a diagram of the head mount display of the present invention which includes a main body 4605*a*, a monitor portion 4605*b*, a band for head fixation 4605*c*, a display portion 4605*d* and an optics system. A display device described in Embodiment Modes and Embodiments 1 to 5 is used in the display portion 4605*d*.

Figure 21F:
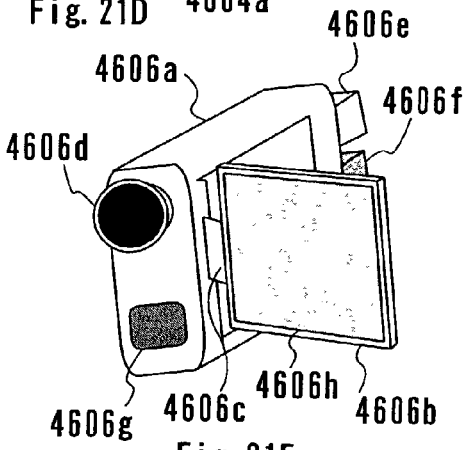

FIG. 21F illustrates a diagram of the video camera of the present invention which includes a main body 4606*a*, a casing 4606*b*, a connection portion 4606*c*, an image receiving portion 4606*d*, an eyepiece 4606*e*, a battery 4606*f*, an sound input portion 4606*g* and a display portion 4606*h*. A display device described in Embodiment Modes and Embodiments 1 to 5 is used in the display portion 4606*h*.

The present invention is not limited to the apparatuses described above. The present invention also can be used in various apparatuses in which the display device described in Embodiment Modes and Embodiments 1 to 5 is used.

In accordance with the structure of the present invention described above, power consumption of a signal line driver circuit, a scanning line driver circuit and a signal control circuit can be reduced. Therefore, a low power consumption display device can be offered.

What is claimed is:

1. A display device having a plurality of pixels arranged in matrix, comprising:

a plurality of signal lines through which signals are inputted to the plurality of pixels;

first and second signal line driver circuits for inputting the signals to the plurality of signal lines, the first signal line driver circuit comprising a first shift register and means for outputting video signals corresponding to digital video signals of n (where n is a natural number) bits to the plurality of signal lines, and the second signal line driver circuit comprising a second shift register and means for outputting video signals corresponding to digital video signals of m (where m is a natural number smaller than n) bits to the plurality of signal lines; and means for selecting between a connection between the first signal line driver circuit and the plurality of signal lines and a connection between the second signal line driver circuit and the plurality of signal lines.

2. A display device according to claim 1, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

3. A display device having a plurality of pixels arranged in matrix comprising:

a plurality of signal lines through which signals are inputted to the plurality of pixels;

first and second signal line driver circuits for inputting the signals to the plurality of signal lines, the first signal line driver circuit having a function of holding digital video signals of n (where n is a natural number) bits corresponding to a row of the plurality of pixels, and the second signal line driver circuit having a function of holding digital video signals of m (where m is a natural number smaller than n) bits corresponding to the row of the plurality of pixels; and means for selecting between a connection between the first signal line driver circuit and the plurality of signal lines and a connection between the second signal line driver circuit and the plurality of signal lines.

4. A display device according to claim 3, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video singals of the n bits to the first signal line driver circuit and an output of the digital video signals of the m bits to the second signal line driver circuit.

5. A display device having a plurality of pixels arranged in matrix comprising:

a plurality of signal lines through which signals are inputted to the plurality of pixels;

first and second signal line driver circuits for inputting the signals to the plurality of signal lines, the first signal line driver circuit having means for outputting video signals corresponding to digital video signals of n (where n is a natural number) bits to the plurality of signal lines, and the second signal line driver circuit operating at a lower driver frequency than that of the first signal line driver circuit and having means for outputting video signals corresponding to digital video signals of m (where m is a natural number smaller than n) bits to the plurality of signal lines; and means for selecting between a connection between the first signal line driver circuit and the plurality of signal lines and a connection between the second signal line driver circuit and the plurality of signal lines.

6. A display device according to claim 5, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

7. A display device according to claim 1, further comprising;

a plurality of scanning lines through which a signal is inputted to the plurality of pixels; and a scanning line driver circuit for inputting the signals to the plurality of scanning lines, wherein the scanning line driver circuit has means for scanning the plurality of scanning lines in an arbitrary order.

8. A display device according to claim 3, further comprising:

a plurality of scanning lines throuth which a signal is inputted to the plurality of pixels; and a scanning line driver circuit for inputting the signals to the plurality of scanning lines, wherein the scanning line driver circuit has means for scanning the plurality of scanning lines in an arbitrary order.

9. A display device according to claim 5, further comprising:

a plurality of scanning lines throuth which a signal is inputted to the plurality of pixels; and a scanning line driver circuit for inputting the signals to the plurality of scanning lines, wherein the scanning line driver circuit has means for scanning the plurality of scanning lines in an arbitrary order.

10. A display device according to claim 1, further comprising:

a plurality of scanning lines throuth which a signal is inputted to the plurality of pixels; and a scanning line driver circuit for inputting the signals to the plurality of scanning lines, wherein the scanning line driver circuit is composed of a decoder.

11. A display device according to of claim 3, further comprising:

a plurality of scanning lines throuth which a signal is inputted to the plurality of pixels;

a scanning line driver circuit for inputting the signals to the plurality of scanning lines;

wherein the scanning line driver circuit is composed of a decoder.

12. A display device according to claim 5, further comprising:

a plurality of scanning lines through which a signal is inputted to the plurality of pixels; and a scanning line driver circuit for inputting the signals to the plurality of scanning lines;

wherein the scanning lines driver circuit is composed of a decoder.

13. A display device according to claim 7, further comprising means for arbitrarity setting a pixel to which the video signal isinputted, by plurality of pixels by one of the first and second signal line driver circuits and scanning line drive circuit.

14. A display device according to claim 8, further comprising means for arbitrarily setting a pixel to which the video signal is inputted, by plurality of pixels by one of the first and second signal line driver circuits and the scanning line drive circuit.

15. A display device according to claim 9, further comprising means for arbitrarily setting a pixel to which the video signal is inputted, by plurality of pixels by one of the first and second signal line driver circuits and the scanning line drive circuit.

16. A display device according to claim 10, further comprising means for arbitrarily setting a pixel to which the video signal is inputted, by plurality of pixels by one of the first and second signal line driver circuits and the scanning line drive circuit.

17. A display device according to claim 11, further comprising means for arbitrarily setting a pixel to which the video signal is inputted, by plurality of pixels by one of the first and second signal line driver circuits and the scanning line drive circuit.

18. A display device according to claim 12, further comprising means for arbitrarily setting a pixel to which the video signal is inputted, by plurality of pixels by one of the first and second signal line driver circuits and the scanning line drive circuit.

19. A display device according to claim 1, wherein the plurality of pixels is arranged by an area color mode.

20. A display device according to claim 3, wherein the plurality of pixels is arranged by an area color mode.

21. A display device according to claim 5, wherein the plurality of pixels is arranged by an area color mode.

22. A display device according to claim 1, wherein the plurality of pixels each have an light emitting element.

23. A display device according to claim 3, wherein the plurality of pixels each have an light emitting element.

24. A display device according to claim 5, wherein the plurality of pixels each have an light emitting element.

25. A display device according to claim 1, the plurality of pixels each have an electron source element.

26. A display device according to claim 3, the plurality of pixels each have an electron source element.

27. A display device according to claim 5, the plurality of pixels each have an electron source element.

28. A display device according to claim 1, wherein an electronic device uses the display device.

29. A display device according to claim 3, wherein an electronic device uses the display device.

30. A display device according to claim 5, wherein an electronic device uses the display device.

31. A display device having a plurality of pixels arranged in matrix, comprising:

a plurality of signal lines through which signals are inputted to the plurality of pixels;

first and second signal line driver circuits for inputting the signals to the plurality of signal lines, the first signal line driver circuit comprising a shift register, a first latch circuit and a second latch circuit for outputting video signals corresponding to digital video signals of n (where n is a natural number) bits to the plurality of signal lines, and the second signal line driver circuit comprising a shift register, a first latch circuit and a second latch circuit for outputting video signals corresponding to digital video signals of m (where m is a natural number smaller than n) bits to the plurality of signal lines; and means for selecting between a connection between the first signal line driver circuit and the plurality of signal lines and a connection between the second signal line driver circuit and the plurality of signal lines.

32. A display device according to claim 31, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

33. A display device according to claim 31, further comprising:

a plurality of scanning lines through which a signal is inputted to the plurality of pixels; and a scanning line driver circuit for inputting the signals to the plurality of scanning lines, wherein the scanning line driver circuit has means for scanning the plurality of scanning lines in an arbitrary order.

34. A display device according to claim 31, further comprising:

a plurality of scanning lines through which a signal is inputted to the plurality of pixels; and a scanning line driver circuit for inputting the signals to the plurality of scanning lines, wherein the scanning line driver circuit is composed of a decoder.

35. A display device according to claim 33, further comprising means for arbitrarily setting a pixel to which the video signal is inputted, by plurality of pixels by one of the first and second signal line driver circuits and the scanning line drive circuit.

36. A display device according to claim 34, further comprising means for arbitrarily setting a pixel to which the video signal is inputted, by plurality of pixels by one of the first and second signal line driver circuits and the scanning line drive circuit.

37. A display device according to claim 31, wherein the plurality of pixels is arranged by an area color mode.

38. A display device according to claim 31, wherein the plurality of pixels each have an light emitting element.

39. A display device according to claim 31, the plurality of pixels each have an electron source element.

40. A display device according to claim 31, wherein an electronic device uses the display device.

41. A display device having a plurality of pixels arranged in matrix, comprising:

a plurality of signal lines through which signals are inputted to the plurality of pixels;

first and second signal line driver circuits for inputting the signals to the plurality of signal lines, the first signal line driver circuit comprising at least one of latch circuit of holding digital video signals of n (where n is a natural number) bits corresponding to a row of the plurality of pixels, and the second signal line driver circuit comprising at least one of latch circuit of holding digital video signals of m (where m is a natural number smaller than n) bits corresponding to the row of the plurality of pixels; and means for selecting between a connection between the first signal line driver circuit and the plurality of signal lines and a connection between the second signal line driver circuit and the plurality of signal lines.

42. A display device according to claim 41, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

43. A display device according to claim 41, further comprising:

a plurality of scanning lines through which a signal is inputted to the plurality of pixels; and a scanning line driver circuit for inputting the signals to the plurality of scanning lines, wherein the scanning line driver circuit has means for scanning the plurality of scanning lines in an arbitrary order.

44. A display device according to claim 41, further comprising:

a plurality of scanning lines through which a signal is inputted to the plurality of pixels; and a scanning line driver circuit for inputting the signals to the plurality of scanning lines, wherein the scanning line driver circuit is composed of a decoder.

45. A display device according to claim 43, further comprising means for arbitrarily setting a pixel to which the video signal is inputted, by plurality of pixels by one of the first and second signal line driver circuits and the scanning line drive circuit.

46. A display device according to claim 44, further comprising means for arbitrarily setting a pixel to which the video signal is inputted, by plurality of pixels by one of the first and second signal line driver circuits and the scanning line drive circuit.

47. A display device according to claim 41, wherein the plurality of pixels is arranged by an area color mode.

48. A display device according to claim 41, wherein the plurality of pixels each have an light emitting element.

49. A display device according to claim 41, the plurality of pixels each have an electron source element.

50. A display device according to claim 41, wherein an electronic device uses the display device.

51. A display device having a plurality of pixels arranged in matrix, comprising:

a plurality of signal lines through which signals are inputted to the plurality of pixels;

first and second signal line driver circuits for inputting the signals to the plurality of signal lines, the first signal line driver circuit comprising a shift register, a first latch circuit and a second latch circuit for outputting video signals corresponding to digital video signals of n (where n is a natural number) bits to the plurality of signal lines, and the second signal line driver circuit operating at a lower drive frequency than that of the first signal line driver circuit and comprising a shift register, a first latch circuit and a second latch circuit for outputting video signals corresponding to digital video signals of m (where m is a natural number smaller than n) bits to the plurality of signal lines; and means for selecting between a connection between the first signal line driver circuit and the plurality of signal lines and a connection between the second signal line driver circuit and the plurality of signal lines.

52. A display device according to claim 51, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

53. A display device according to claim 51, further comprising:

a plurality of scanning lines through which a signal is inputted to the plurality of pixels; and a scanning line driver circuit for inputting the signals to the plurality of scanning lines, wherein the scanning line driver circuit has means for scanning the plurality of scanning lines in an arbitrary order.

54. A display device according to claim 51, further comprising:

a plurality of scanning lines through which a signal is inputted to the plurality of pixels; and a scanning line driver circuit for inputting the signals to the plurality of scanning lines, wherein the scanning line driver circuit is composed of a decoder.

55. A display device according to claim 53, further comprising means for arbitrarily setting a pixel to which the video signal is inputted, by plurality of pixels by one of the first and second signal line driver circuits and the scanning line drive circuit.

56. A display device according to claim 54, further comprising means for arbitrarily setting a pixel to which the video signal is inputted, by plurality of pixels by one of the first and second signal line driver circuits and the scanning line drive circuit.

57. A display device according to claim 51, wherein the plurality of pixels is arranged by an area color mode.

58. A display device according to claim 51, wherein the plurality of pixels each have an light emitting element.

59. A display device according to claim 51, the plurality of pixels each have an electron source element.

60. A display device according to claim 51, wherein an electronic device uses the display device.

61. A display device having a plurality of pixels arranged in matrix, comprising:

a plurality of signal lines through which signals are inputted to the plurality of pixels;

first and second signal line driver circuits for inputting the signals to the plurality of signal lines, the first signal line driver circuit having a function of holding digital video signals of n (where n is a natural number) bits corresponding to a row of the plurality of pixels, and the second signal line driver circuit operating at a lower drive frequency than that of the first signal line driver circuit and having a function of holding digital video signals of m (where m is a natural number smaller than n) bits corresponding to the row of the plurality of pixels; and means for selecting between a connection between the first signal line driver circuit and the plurality of signal lines and a connection between the second signal line driver circuit and the plurality of signal lines.

62. A display device according to claim 61, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the m bits to the second signal line driver circuit.

63. A display device according to claim 61, further comprising:

a plurality of scanning lines through which a signal is inputted to the plurality of pixels; and a scanning line driver circuit for inputting the signals to the plurality of scanning lines, wherein the scanning line driver circuit has means for scanning the plurality of scanning lines in an arbitrary order.

64. A display device according to claim 61, further comprising:

a plurality of scanning lines through which a signal is inputted to the plurality of pixels; and a scanning line driver circuit for inputting the signals to the plurality of scanning lines, wherein the scanning line driver circuit is composed of a decoder.

65. A display device according to claim 63, further comprising means for arbitrarily setting a pixel to which the video signal is inputted, by plurality of pixels by one of the first and second signal line driver circuits and the scanning line drive circuit.

66. A display device according to claim 64, further comprising means for arbitrarily setting a pixel to which the video signal is inputted, by plurality of pixels by one of the first and second signal line driver circuits and the scanning line drive circuit.

67. A display device according to claim 61, wherein the plurality of pixels is arranged by an area color mode.

68. A display device according to claim 61, wherein the plurality of pixels each have an light emitting element.

69. A display device according to claim 61, the plurality of pixels each have an electron source element.

70. A display device according to claim 61, wherein an electronic device uses the display device.

71. A display device having a plurality of pixels arranged in matrix, comprising:

a plurality of signal lines through which signals are inputted to the plurality of pixels;

first and second signal line driver circuits for inputting the signals to the plurality of signal lines, the second signal line driver circuit operating at a lower drive frequency than that of the first signal line driver circuit and having at least one of latch circuit of holding digital video signals of n (where n is a natural number) bits corresponding to a row of the plurality of pixels, and the second signal line driver circuit comprising at least one of latch circuit of holding digital video signals of m (where m is a natural number smaller than n) bits corresponding to the row of the plurality of pixels; and means for selecting between a connection between the first signal line driver circuit and the plurality of signal lines and a connection between the second signal line driver circuit and the plurality of signal lines.

72. A display device according to claim 71, further comprising a signal control circuit to which a video signal is inputted, wherein the signal control circuit includes:

means for holding n-bit signals of the video signal, reading the held n-bit signals in order, outputting the read n-bit signals as the digital video signals of the n bits;

means for holding m-bit signals of the video signal, reading the held m-bit signals in order, outputting the read m-bit signals as the digital video signals of the m bits; and means for selecting between an output of the digital video signals of the n bits to the first signal line driver circuit and an output of the digital video signals of the in bits to the second signal line driver circuit.

73. A display device according to claim 71, further comprising:

a plurality of scanning lines through which a signal is inputted to the plurality of pixels; and a scanning line driver circuit for inputting the signals to the plurality of scanning lines, wherein the scanning line driver circuit has means for scanning the plurality of scanning lines in an arbitrary order.

74. A display device according to claim 71, further comprising:

a plurality of scanning lines through which a signal is inputted to the plurality of pixels; and a scanning line driver circuit for inputting the signals to the plurality of scanning lines, wherein the scanning line driver circuit is composed of a decoder.

75. A display device according to claim 73, further comprising means for arbitrarily setting a pixel to which the video signal is inputted, by plurality of pixels by one of the first and second signal line driver circuits and the scanning line drive circuit.

76. A display device according to claim 74, further comprising means for arbitrarily setting a pixel to which the video signal is inputted, by plurality of pixels by one of the first and second signal line driver circuits and the scanning line drive circuit.

77. A display device according to claim 71, wherein the plurality of pixels is arranged by an area color mode.

78. A display device according to claim 71, wherein the plurality of pixels each have an light emitting element.

79. A display device according to claim 71, the plurality of pixels each have an electron source element.

80. A display device according to claim 71, wherein an electronic device uses the display device.

* * * * *